United States Patent [19]

Nudelman

[11] Patent Number: 4,704,635

[45] Date of Patent: Nov. 3, 1987

[54] LARGE CAPACITY, LARGE AREA VIDEO IMAGING SENSOR

[76] Inventor: Sol Nudelman, 222 Stagecoach Rd., Avon, Conn. 06010

[21] Appl. No.: 815,864

[22] Filed: Jan. 2, 1986

Related U.S. Application Data

[63] Continuation-in-part of Ser. No. 683,245, Dec. 18, 1984, abandoned, which is a continuation-in-part of Ser. No. 610,114, May 14, 1984, abandoned.

[51] Int. Cl.[4] ..... H01J 31/38

[52] U.S. Cl. ..... 358/217; 313/366; 315/12.1

[58] Field of Search ..... 358/217, 219; 313/266, 313/287, 288, 290, 366, 370; 315/364, 11, 12.1

[56] References Cited

U.S. PATENT DOCUMENTS

| | | | |
|---|---|---|---|
| 2,732,469 | 1/1956 | Palmer | 358/217 |
| 3,289,024 | 11/1966 | De Haan | 313/366 |
| 3,356,793 | 12/1967 | Yaggy | 358/217 |
| 3,360,671 | 12/1967 | Salgo | 313/366 |
| 3,444,412 | 5/1969 | De Haan | 313/368 |
| 3,487,250 | 12/1969 | Klopping | 313/266 |
| 3,644,770 | 2/1972 | Bell | 313/366 |
| 3,710,125 | 1/1973 | Jacobs | 313/380 |
| 3,792,197 | 2/1974 | Chai | 358/217 |
| 3,806,751 | 4/1974 | Takemoto | 313/366 |
| 3,851,205 | 11/1974 | Picker | 315/12.1 |
| 3,857,637 | 12/1974 | Tomii | 313/65 |
| 3,881,104 | 4/1975 | Donjon | 250/213 VT |
| 3,919,587 | 11/1975 | Sato | 315/12.1 |
| 3,952,222 | 4/1976 | Rose | 313/366 |
| 4,059,840 | 11/1977 | Van De Polder | 358/217 |
| 4,086,512 | 4/1978 | Digleman | 313/366 |
| 4,117,515 | 9/1978 | Carasso | 358/217 |
| 4,255,686 | 3/1981 | Maruyama | 313/366 |
| 4,366,413 | 12/1982 | Washida | 313/377 |
| 4,398,118 | 8/1983 | Galves | 313/527 |
| 4,488,083 | 12/1984 | Inoue | 313/366 |
| 4,492,981 | 1/1985 | Taketoshi | 313/366 |

FOREIGN PATENT DOCUMENTS

| | | | |
|---|---|---|---|
| 108385 | 5/1984 | European Pat. Off. | 313/366 |
| 2424908 | 12/1974 | Fed. Rep. of Germany | 313/368 |
| 53-124963 | 10/1978 | Japan | 313/366 |
| 55-453820 | 4/1979 | Japan | 358/217 |
| 107253 | 8/1979 | Japan | 358/217 |
| 55-162673 | 12/1980 | Japan | 358/217 |

OTHER PUBLICATIONS

Hunten, D. M., "Performance . . . ", *Applied Optics,* vol. 15, No. 12, Dec. 1976, pp. 3105–3110.

Miyashiro, "SEM Camera Tube," *IEEE Transactions on Electron Devices,* vol ED-18, No. 11, Nov. 1971, pp. 1023–1028.

*Primary Examiner*—Gene Z. Rubinson
*Assistant Examiner*—L. C. Schroeder
*Attorney, Agent, or Firm*—Hall, Myers & Rose

[57] ABSTRACT

Deleterious effects of high capacitance in large area raster scanner image tubes, especially when employed in video cameras, can be overcome by employing the following features: (1) a plurality of transparent stripe signal electrodes; (2) a unique, multiple layer, solid state structure designed to provide a Displaced Electron Layer-Sensor-Target for imaging (hereinafter DELST), with and without; (3) photoconductive gain in the DELST structure; and (4) with and without intensifier gain in the DELST structure, the proper combination of these four features makes possible the construction of video sensor devices of extraordinarily large capacitance, having rasters generated by "low or high" velocity scanning electron beams, or a laser scanning ray. The invention provides a generic approach for the selection of features and their combination with the type of scanner best suited to any one application. The choice is dependent upon system requirements such as speed, spatial resolution, dynamic range, sensor-target size and cost.

121 Claims, 18 Drawing Figures

LARGE CAPACITY, LARGE AREA VIDEO IMAGING SENSOR

PROSECUTION HISTORY

This is a continuation-in-part application of Ser. No. 683,245 filed Dec. 18, 1984 now abandoned which in turn was a continuation-in-part application of Ser. No. 610,114 filed May 14, 1984 now abandoned.

FIELD OF THE INVENTION

The present invention relates to scanning image tubes especially those employed in video cameras. It is directed particularly to those devices which benefit from or require a sensor-target to have a large area capacity to perform optimally in an application such as to image the chest or abdomen of an adult with X-rays.

BACKGROUND OF THE INVENTION

In the past, video camera tubes have been designated "low velocity" or "high velocity". Low velocity tubes have typically featured better detective quantum efficiency and contrast than high velocity tubes. High velocity tubes have, on the other hand, typically featured better lag performance (less lag) and spatial resolution and permitted the use of larger capacity layers in the sensor-target than low velocity tubes. Such characteristics are discussed in (1) the *Electronics Engineers' Handbook,* Second Edition, edited by Donald G. Fink, 1982; (2) *Television Camera Tubes: A Research Review* by P. K. Weimer in *Advances in Electronics & Electron Physics,* Vol. XIII, pp. 387, Academic Press, New York and London, 1960 (3) *Photoelectronic Imaging Devices,* Edited by L. M. Biberman and S. Nudelman, Plenum Press, New York, 1971; 4. *Electronic Image Storage* by B. Kazan and M. Knoll with contributions by Wittarth, Academic Press, New York and London, 1967; 5. *The High Beam Velocity Vidicon* by J. Dresner R.C.A. Review, 305, June 1961; and 6. *Advances in Image Pickup & Display,* Ed. by B. Kazan, Volumes I & II, 1974, 1975 Academic Press, New York and London. The desirable features of both the low velocity tube and of the high velocity tube have not, until the present invention, been incorporated into a single tube. It should be noted that the low velocity tube currently is the only tube used in practice due to its higher efficiency and contrast.

Two classes of scanner image tubes are currently in use. The first operates "without" gain and is exemplified by the vidicon, Plumbicon, Chalnicon, Saticon, Newvicon and Silicon vidicon. The second operates "with" gain and is used in situations where there is insufficient light to operate "without" gain. These tubes are exemplified by the image orthicon, SEC and SIT tubes. The unique feature of this latter group is the incorporation of a front end intensifier structure designed to provide image charge multiplication. In both classes of tubes, it is observed that there is included an imaging section and an electron beam scanning section. It should be noted, however, that in the "no gain" tube, the imaging section comprises simply a disc-like layer of material. It serves the dual function of being a photon sensor and a target on which to store a layer of electronic charge. For this reason, it is referred to herein as the sensor-target.

In a "low velocity," no gain tube, the electron beam scans the inside surface of the sensor-target in a raster scanning fashion. It scans adjacent parallel lines of the sensor-target one after another. The electrons arrive at the sensor-target surface with low energies, and in particular, too low to cause any secondary electron emission. In the process, it deposits electrons uniformly across the surface and drives it to approximately the potential of the electron gun chathode which is usually at or near ground. Secondly, the electron beam generates a time varying video signal as it scans through the raster. This results from modification of the charge on the sensor target as a result of projection of the optical image onto the input sensor surface of the image tube. The process occurs on a successive pixel by pixel basis as electrons lost on the target surface through image formation are replaced by the scanning electron beam.

The imaging section incorporates a medium with two functions; a sensor responsive to the incident radiation to be imaged and an insulating target having a resistivity on the order of $10^{12}$ ohm cm. The high resistivity is essential to maintaining electron charge storage and immobility on the inner scanned surface of the sensor-target during a raster scanning period. On exposure of the sensor-target to incident radiation, from an image of an object, there results a flow of charge through the medium such that electrons are lost from the scanned surface. Accordingly, electrons are lost across the surface in numbers proportional to the changing intensity of irradiation comprising the incident image. The resultant electronic image is "readout" by the scanning electron beam.

The tubes "with gain" have a forefront intensifier type structure which separates the sensor from the target. As a result, the sensor changes from a vidicon photoconductor to a photoelectron emitter.

In operation, photoelectrons generated from the sensor's absorption of incident irradiation are accelerated in the tube vacuum by the intensifiers electron optics and are imaged onto the target's outer surface. The electrons strike that surface with sufficient energy to cause charge multiplication and a loss of a proportionate number of electrons stored on the targets inner surface. As a result, the scanning electron beam must replace more stored electrons per absorbed photon than in the "no gain" tube, and the video signal is amplified.

The scanner image tubes and the prior art have experienced various problems, especially where large target area is required. Conventional low velocity tubes in such applications suffer when the high beam resistance is coupled to the large capacity to result in undesirable excessive lag. Large capacitance can result from increasing the size of the target, increasing the mediums dielectric constant and/or decreasing its thickness.

In general, numerous factors must be considered if the scanner image tube is to perform effectively and optimally. Besides the sensor-target's capacity and distributed capacity, other factors include the energy of the electron beam, its resistance and current, as well as the modulation transfer function (MTF) of the tube's imaging components. The latter depends on such factors as target thickness, the lateral displacement of charge stored on the sensor-target inner surface during a raster period, and beam current discharge characteristics.

Moreover, a high detective quantum efficiency (DQE) of preferably 100% is a desired feature for an optimal scanner image tube. A DQE of 100% corresponds to a sensor having a quantum efficiency of 100%; output noise limited by the photon noise at the input where the image is projected initially—i.e. photon noise, should dominate other electronic sources of noise; and the MTF high enough to assure that the dynamic range matches the imaging requirement throughout the necessary spatial frequency spectrum.

For large area X-ray imaging, conventional, low velocity beam scanner tubes have failed to meet the needs of diagnostic radiology. As an alternative approach, X-ray intensifiers have been developed with diameters up to 22 inches. Such intensifiers are than optically coupled to a conventional sized TV camera. These systems are used in fluoroscopy and diagnosis. They suffer from intrinsically poor spatial resolution compared to that of the X-ray sensor. This results from multiplication of component MTF's. Poor spatial resolution manifests itself medically in two ways, i.e., in reduced diagnostic performance and increased dose to the patient. These deficiencies must be overcome.

The operation of a "high velocity" beam video tube differs from the "low velocity" beam in that the electrons of the scanning beam are made to strike the inner surface of the sensor-target with sufficient energy to cause secondary electron emission. In an ideal tube, the electron bombarded surface gives off secondary electrons, which are collected by "collecting" electrodes. In this process the scanned surface becomes positively charged because of the lost secondary electrons, and the surface voltage rises until at equilibrium, the scanning beam is essentially equivalent to the collected beam.

When the sensor is then exposed to incident light there is a loss of positive charge in a manner that causes an electronic image reproduction of the incident irradiation image. The scanning beam then is able to replace the positive charge lost through secondary electron emission until the equilibrium potential is reached. In the process of replacing lost charge, it generates a corresponding video signal on a pixel-by-pixel basis which effectively creates the time varying video signal that is similar to that from the "low velocity" tube.

The Iconoscope, in the United States, and its counterpart, the Emitron, in Great Britain, were the first video tubes to incorporate the features of "high velocity" scan and the principle of charge storage.

The Iconoscope, however, suffered from the low sensitivity and poor efficiency resulting in large part from poor collection and redistribution effects of secondary electrons.

A "high velocity" tube with a photoconductive sensor target was demonstrated in experimental tubes in the early 1950's. The purpose was to develop a new concept which would overcome the problems of lag and limited sensitivity. It was discovered that under certain conditions of operation, the tube could be made to operate with a high capacity target and provide improved lag performance. Furthermore, the higher capacity (thinner) targets also offered superior spatial resolution, and in. theory, were expected to provide superior quantum efficiency. Redistribution effects were reduced in that the photoemitted electrons did not exist. The secondary electrons generated during scanning were less of a problem in one mode of operation and worse in the other. Shading continued to be bothersome, but again on a reduced scale due to better collector design. Nevertheless, the approach was dropped as the low velocity vidicon-type tubes were improved to the point where the met industrial and broadcast requirements.

However, applications exist that require the use of large capacity targets. These cannot be carried out with the conventional "low velocity vidicons" where target capacity and stray capacity must be limited. The "high velocity" approach can serve as the basis for a new invention which offers the opportunity to provide a new imager able to combine the best features of the "high and low" velocity tubes.

Diagnostic radiology, for example, requires large area imaging with attendant sensor-target capacity and distributed capacity both prohibitively large with "state of the art" video tubes.

Solid state sensor panels employed in X-ray imaging are under development but suffer from other disadvantages. Some such sensor panels provide that readout be performed on the same side of the panel that is exposed. Moreover, the panel undergoes a cycling of voltages to respectively effectuate charging, reading, writing, erasing, and recharging. Accordingly, the panel must be transported from one station to another, rendering rapid imaging impossible. When such a system is automated, a large mechanical transporter is incorporated to move the panel from the exposure platform to its readout station. Disadvantages include cost, space occupied by the system, and the time involved to complete the process.

SUMMARY OF THE INVENTION

The present invention improves over prior art scanner image tubes by overcoming various disadvantages and shortcomings set forth hereinbefore and by incorporating features that provide for more optimal operation.

To achieve such ends, the present invention has as an object reducing, if not eliminating, the negative effects of beam resistance and capacitance in a low velocity image tube.

Moreover, the present invention has as another object the realization of advantages relating to both low velocity beams and high velocity beams in a scanner image tube. That is, the present invention provides for good lag performance, for good spatial resolution, and for the use of large capcity layers in the sensor-target as well as providing for a high DQE and good contrast.

It is another object to provide a scanner image tube useful in radiology, especially in applications requiring a large area sensor—such as imaging a human chest. In this regard, a scanner image tube is provided that can be operated in near real-time or in snap shot applications. In diagnostic radiology, the large majority of X-ray pictures are simply "snap-shots" as exemplified by the simple chest radiograph. Most procedures in angiography require repetition rates up to 7.5 frames/sec., while studies of the adult heart and coronary arteries can require real time imaging, i.e., 30 frames/sec.

Yet another object of the present invention is to significantly reduce the effective capacitance of large area imaging tubes by employing transparent, parallel stripe signal electrodes arranged side by side, parallel to the tube's scanning raster.

Still another object of the present invention is to reduce the beam resistance and capacitance of large area imaging tubes.

It is still a further object to minimize the magnitude of distributed capacity associated with preamplifier noise. This capacity increases with the area of the sensor-target in conventional "low velocity" and "high velocity" video tubes. By dividing the signal electrodes into stripes, whose length may be the length of a scan line, and whose width can encompass one or more scan lines, the area and distributed capacity associated with an individual preamplifier attached to a stripe can be sharply reduced. This approach requires multiplexing or a separate preamplifier per electrode stripe for optimal performance with the total given by the number of raster lines divided by the number of raster lines per stripe.

It is yet a further object of the invention to achieve high sensitivity in a tube having a super high velocity beam. Prior high velocity beam tubes have produced secondary electron emission that result in the backscattering of some of these emitted electrons back onto the sensor during scanning, causing image quality degradation. The present invention can employ a super high velocity beam without such attendant degradation.

It is still yet another object to optimize sensor quantum efficiency by permitting a thin layer of, for example, crystalline antimony trisulfide to be used as a sensitive sensor—the high capacity and high lag related thereto being compensated for in the invention, particularly by providing effectively a relatively low beam resistance. Lag, it is noted, arises from the failure of the beam to return the surface of a target to the charged potential after a single scan. In viewing an image, undesirable smear results from lag.

It is still a further object to provide readout and recharging during beam scanning and to provide more electrons for recharging than are required.

It is yet a further object to provide, in various embodiments of the invention, charge multiplication or gain as needed using properties of the source of the scanning beam and the target. The invention thereby directs a more copious flow of electrons to effect readout and recharge of the target than is produced by the source.

In one embodiment, these and other objects are achieved by a scanner image sensor target including a first electrode; a second electrode and grounded through a resistor, said first electrode being positive relative thereto; a first solid state layer; a second layer; and means for a raster scanning beam of irradiation; wherein said first layer is sandwiched between said first electrode and said second layer; and wherein said second layer is sandwiched between said first layer and said second electrode, and wherein said raster scanning means directs irradiation beams into said second layer through said second electrode, said second layer generating electrons which are conveyed toward the interface with the first layer for storage thereat; the electrons stored at the interface forming an electron layer displaced from said second electrode, the electrons of said electron layer being combinable with holes generated in said first layer in response to imaging irradiation passing through said first electrode into said first layer; the combining of holes from said first layer with electrons from the said second layer at the interface forming an electronic image thereat. Accordingly, in one version an imaging pattern of irradiation in a given spectral ban strikes the first layer in the image section which generates free electrons and holes. The holes, in a pattern analogous to the pattern of irradiation, drift toward the interface under the influence of the electric field forming an electronic image thereat. Accordingly, the free electrons drift away from the interface toward the first electrode. The holes combine with electrons at the interface to form an electronic image thereat. Scanning with the beam results in readout and recharging at the same time.

Hence, it is an object to permit image acquisition and processing simultaneously or consecutively, as desired, at a single station. This structure avoids the negative effects of charge redistribution from both photoemission and secondary electron emission which doomed the success of the Iconoscope for example for such uses.

It is noted that the two electrodes represent plates of a capacitor and the first layer and the second layer from the dielectric therebetween. The second layer is subject to local charge multiplication where a scanning beam of electrons strikes and generates more electrons (or electron-hole pairs). Hence, a beam striking the second layer can produce almost a short circuit between the second electrode and the interface along a path determined by the beam—resulting in a low beam resistance. It is thus an object of the invention to increase tube performance and adaptability by reducing beam resistance alone and in conjunction with reducing capacitance by the utilization of striped electrodes.

It is to be noted that the combination of layers and electrodes as described above, creates a structure which permits electron charge storage required for image formation to occur at the interface of the two layers. This location is displaced from its position in a conventional video tube, and is intrinsic to this invention. Accordingly, the structure which provides the Displaced Electron Layer in the Sensor-Target will be referred to as DELST.

Moreover, it is observed that the beam can cause sufficient charge multiplication in the second layer along a path between the second electrode and a pixel at the interface—to provide practically a short circuit therebetween. It is, therefore, an object to permit an increase in the capacity of the sensor target by effectuating charge multiplication up to breakdown in the second layer in response to the irradiating thereof by the beam. This mechanism is designed to permit use of the high area capacity sensor-target with minimal lag.

It is a further object of the invention to provide a scanner image device that can be scanned either by a laser or by a high velocity electron beam, each beam passing through a beam section electrode and into a layer of selected material. The selected material is responsive to the beam irradiation and generates electrons that charge or recharge an electron layer displaced from the beam section electrode. Preferably, the selected material is subject to local avalanche breakdown triggered by the beam on a pixel-by-pixel basis. The breakdown provides a substantial short circuit through a pixel across the layer of selected material. It ensures an adequate supply of electrons for all applications.

It is still a further object of the invention to reduce or avoid the need for charge multiplication in those applications where the electron beam or a laser beam scanner provides sufficient generation of charge for storage and signal readout.

It is yet a further object of the invention, where using a scanning laser beam to avoid the vacuum requirement of the electron beam scanning tube, by system design whereby the sensor-target is made as a stand-alone component, as is the laser beam scanner.

It is still yet another object, in various embodiments, to provide gain to charges approaching the interface from both the image section and the beam section of the scanner image sensor-target of the invention to increase the signal-to-noise ratio and enhance other characteristics of the tube.

It is still a further object of the invention to minimize the problem of large area capacity relative to associated electronic noise by selective electrode geometrical configurations.

It is yet a further object to provide a relatively low-cost scanner image sensor-target employable in X-ray environments and in contexts ranging from high energy applications of particle and photon radiology to low energy uses throughout the electromagnetic spectral regions.

It is furthermore an object to incorporate sufficient photoconductive gain in a sensor target to increase the video signal level in a video imaging system. Such increases can be used in low light level applications and in overcoming electronic noise problems.

It is a principal object to minimize interelectrode, or shunting capacity. In a super high velocity tube (in the kilovolt range) using video display type electron-optics, the conventional field mesh and suppressor mesh of low velocity beam operation are omitted. In a laser-scanner device, all the electrodes of a typical video tube are eliminated.

It is another principal objective to reduce the requirements on the sensor thereby to avoid the limitations of space charge limited performance. This is managed by requiring the sensor to detect incident radiation and if necessary provide gain, while charge storage at the interface is required of the target and not of the sensor.

It is still another principal objective to minimize capacitance associated with preamplifier induced noise, for ultimate performance in the most demanding of requirements, by eliminating the second electrode completely across the outer of the second layer. Flood guns and bias light are added to the device which in combination with the scanning beam determine the equilibrium charge deposited on the outer surface as well as its operating equilibrium potential.

It is furthermore an objective to use the combination of flood guns and bias light with the second electrode in place, but without connection to the grounded resistor or to ground. This design can be of advantage in certain applications.

BRIEF DESCRIPTION OF THE DRAWINGS

FIG. 7 shows the beam striking one surface of a sensor-target, and FIG. 8 shows radiation impinging the opposite surface of the sensor-target. FIG. 9 shows readout.

FIG. 12*a* illustrates a generalized arrangement that utilizes the channel multiplier of FIG. 12.

DESCRIPTION OF THE INVENTION

Figure 1:
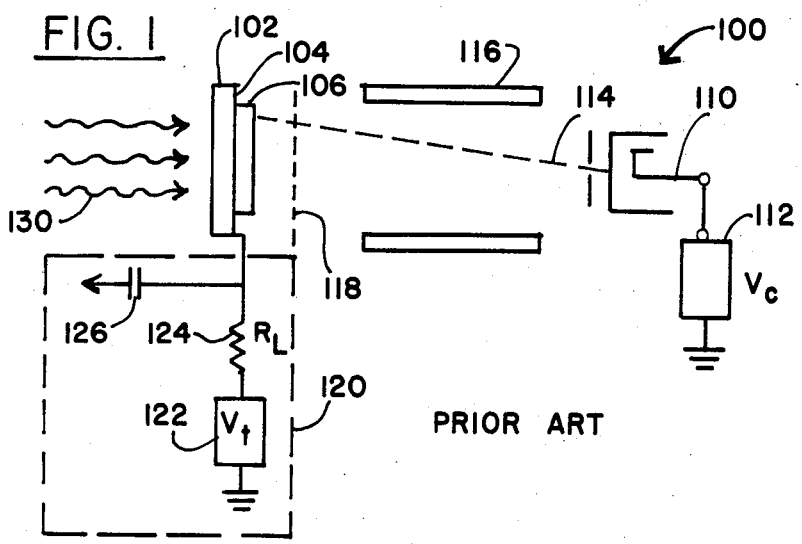
FIG. 1 is a side-view illustration of a first embodiment of a scanner image tube employed in the invention.

The essence of the invention is to provide a large capacity video type imager that is able to function in a manner that overcomes the customary limitations imposed by large target and large distributed capacities.

One version makes use of parallel stripe electrodes spread across the sensor-target surface to offset large distributed capacity and in a further preferred embodiment, a "high velocity" beam is used in overcoming the problem of large target capacity. This version requires that a translating fan beam of incident radiation whose projection is parallel to the stripe electrodes, be the source of exposing radiation. The stripe electrodes are particularly important when the cross-sectional area of the sensor is required to be large, as in the case of diagnostic radiology. The invention offers freedom of design even in the case of small dimension sensor applications of using high dielectric constant materials for the sensor-target to increase target capacity. The advantage derived is in the target-sensor being able to store a larger charge, and thereby offer the opportunity to increase the dynamic range of the imager.

The combination of a scanning beam with stripe electrodes provides the means for achieving maximum spatial resolution for the large dimension sensor, since readout occurs at the primary sensor-target. It avoids the intrinsic limitations of conventional systems used, for example, in diagnostic radiology. There, X-ray intensifiers are designed with a large degree of demagnification, and then have their output optically coupled to a video camera tube. The result is a substantial loss of resolution to the extent where the system is limited principally to fluoroscopy and to intravenous angiography. A purpose of this invention is to provide a large area X-ray video imager able to meet the needs of diagnosis as distinct from fluoroscopy, for most of the procedures used in the practice of diagnostic radiology.

Another version uses super "high velocity" electrons (kilovolt energies) and video display type electron-optics. This type of operation eliminates much of the usual interelectrode capacitance and minimizes the total distributed or shunt capacity. It effectively reduces "gain" requirements on the sensor and also reduces, if not eliminates, the need for stripe electrodes. Furthermore, the effective RC time constant is reduceable by offsetting large target capacitance with a dramatic decrease in beam resistance.

Still, another version uses a laser scanner to generate photoelectrons in a semiconducting target for charging and recharging a storage surface. It effectively eliminates interelectrode capacity, provides reduced beam impedance, and permits operation with a large target capacity.

The "super high velocity" scanning electron beam and the laser scanner versions use a basic two-layer structure, comprising a sensor layer adjacent to a target layer. In one mode of operation, the target layer must have the high resistivity associated with video charge storage as exemplified by SEC and EBIC targets in conventional "low velocity" scan tubes. Positive charge created during the scanning process is stored on the target surface adjacent to the inner surface of the sensor. The sensor layer must absorb incident radiation and convert it into representative charge which is transported to the interface between the sensor and target, where it discharges proportionately, the beam induced stored charge. Since the stored charge layer is displaced from the outer (scanned) surface where it resides in a typical video tube operation to the inner surface at the interface, the structure is referred to as a "Displaced Electron Layer Sensor-Target," abbreviated as DELST.

The "super high velocity" tube is defined in several configurations involving different active layers as well as with and without the use of flood guns and bias light. When used with flood guns and bias light, the electrode covering the target layer is either operated in a floating condition or is removed completely. This configuration provides minimal capacitance problems at the expense of additional tube complexity.

In the DELST structure, there is opportunity for sensor photoconductive gain. This is possible because the conditions of "space charge limited" performance car be avoided in the sensor when it does not have to sustain stored charge.

1. Operation with "Low" and "High" Velocity Video Tubes

Referring to FIG. 1, a first embodiment scanner image tube 100 according to the invention is illustrated. The tube 100 has essentially the same structure for operation as a "low velocity" or a "high velocity" vidicon. The front end comprises a supporting member 102 on which is deposited a conducting layer electrode 104 and a photoconducting layer 106. When the incident radiation 130 is light, the front end member 102 is glass and 104 is a light transparent, electrically conducting layer suitable for applying a bias voltage from source 122 to the outer surface of the photoconductor 106. The photoconductive layer 106 is selected to be responsive to the light. When the incident radiation is X-ray, the structure 102 can be metal known to be transparent to the radiation. In the simplest configuration, the metal combines the role of the supporting member 102 and the transparent electrode 104. The photoconductor 106 is then selected to be responsive to X-rays. The materials sensitive to the other known types of radiaton (gamma, alpha, ionic, cosmic, beta, neutrons, etc.) are well known so that the tube may be made responsive to substantially, if not all, of the various types of radiant energy. For imaging with X-rays, the sensor-target 106 comprises an efficient absorber of X-ray radiaton, CsI, which efficiently converts the incident X-ray into light emission. The light, in turn, is absorbed by an adjacent layer of light sensor photoconductor with a transparent conducting electrode at the interface between the light emitter and the photoconductor to apply the bias voltage for the photoconductor.

The electrode 104 is connected to a conventional video readout circuit 120 that includes a voltage source 122 which biases the electrode 104 relative to ground and a capacitor 126 which carries the video signal to a preamp. The resistance 124 serves as a load resistor to develop the video signal.

Also shown in FIG. 1 is an electron gun cathode 110 which provides electrons to form an electron beam 114 and which is directed by electron-optics 116 to scan a raster on the inner surface of the photoconductor 106. Depending upon the bias voltages applied through $V_t$ to electrode 104, $V_c$ to the cathode 110 and that applied to the grid 118, the tube can operate either as a "low velocity" or a "high velocity" vidicon.

The biases for "low velocity" operation are selected so that the energy of the beam electrons is too low when arriving at the inner-scanned surface of the photoconductive layer 106 to cause any secondary electron emission. Typical for a vidicon would be the electrode bias 122 set at 30 volts and the gun cathode bias $V_c$ set at ground. The grid 118 is called the "decelerating grid" and has the function of slowing down the electrons so that their arrival of 106 will be with energies too low to cause any secondary electron emission. Accordingly, its voltage is positive with respect to ground, and typically about 1000V.

In operation, electrons deposited on the inner surface of 106 cause its voltage to become essentially the same as the cathode described above as ground.

The biases for "high velocity" operation are selected to ensure that tube performance is governed by secondary electron emission. An example of bias settings used by Dresner (see reference) is a bias voltage of $V_t=+300$ volts for electrode 104, the electron gun cathode 110 set at $V_c=0.0$ volts (ground) and the grid 118 ($V_g$) set at 320 volts. This is designed so that the beam 114 electrons have sufficient energy to cause secondary electrons to be emitted from the scanned surface of the photoconductive layer 106. They are collected by the grid 118, and accordingly, it is called the "collector" grid.

In operation, the scanned surface of layer 106 acquires a positive equilibrium potential such that the net target current equals zero. The equilibrium voltage $V_o$ is determined by the collector voltage $V_g$ and lies a few volts above it. For a fixed $V_g$, the potential across layer 106 depends upon $V_t$ applied to electrode 104. Accordingly, the photocurrent can be made to flow in either direction according to whether $V_t$ is larger or smaller than the equilibrium potential $V_o$.

In dealing with low and high velocity vidicon performance, particularly where large values of target and distributed capacities apply, it is prerequisite that their operation must be properly modified for optimum performance. The case of X-ray imaging for diagnostic radiology is compared with conventional light imaging to point out the difficulties in operation, and the new device conception to overcome these difficulties.

Figure 2:
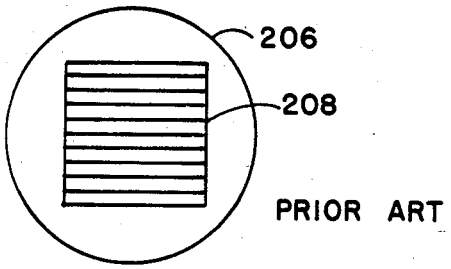
FIG. 2 is a front view illustration of a sensor-target employed in the embodiment of FIG. 1.

Reference to FIG. 2 shows the circular sensor-target 206 identified in FIG. 1 as 106. Traced on this target is a raster, whose vertical and horizontal dimensions, are taken equal (a square) for simplicity. The typical sensor-target capacity for a small video tube using a low velocity vidicon target using antimony trisulfide is on the order of 1000–4000 picofarads, although special tubes can be found with larger values. Assume for simplicity that a 1"×1" raster is used and that the target capacity is 1000 picofarads. If this tube were enlarged to provide a 16"×16" raster to meet the needs of diagnostic radiology, the capacity would grow in proportion to the increased area and be as large as 256,000 picofarads.

Correspondingly, the distributed capacity can be expected to grow, at worst, in a manner proportional to the increased area. The distributed capacity of the small size "low velocity" tube is in the range of 2–25 picofarads, depending upon the manufacturer. Assuming a favorable value of 5 picofarads for the small tube, the large area tube could have a distributed capacity of about 1,280 picofarads.

The implication of these large capacitance values can be discerned by the associated capacitive lag and the preamplifier noise. The scanning beam, instead of acting as a constant current source, acts as a resistance of the order of $10^7$ ohms. Assuming a target capacity of 1000 picofarads for the small tube, the RC time constant becomes $10^7 \times 1000 \times 10^{-12} = 0.01$ secs. Since the raster period at 30 frames/sec=0.03 secs., the RC time constant is clearly usable.

However, for the large diameter tube, the capacity grows to 256,000 picofarads and the RC time constant to 2.56 secs. This value causes the tube to be excessively laggy for use in conventional video imaging and even in X-ray imaging using snap-shot operation.

The distributed (interelectrode-shunt) capacity is related to preamplifier noise through the expression $$i_{N1}(\text{PREAMP}) = \sqrt{4kT \cdot \frac{4\pi}{3} \cdot R_e \cdot C_d^2 \cdot \Delta f^3} = \quad (1)$$

$$1.38 \times 10^{-23} \text{ Joules}/k$$

where k=Planck-Boltzmann Constant t=Absolute Temperature=300

$R_e$=Equivalent Noise Resistance of First Stage Preamplifier Resistance $C_d$=Distributed or Stray Capacity to Ground From Signal Leads f=Electrical Bandwidth Assume $R_e$=40 ohms $C_d$=5 picoforads for the small tube $\Delta f = 10^7$ hertz which leads to $i_{N1}$PREAMP)=0.264 na.

When $C_d$=1280 picofarads for the large tube is used, the preamplifier noise current grows by a factor of 256 and the preamp noise becomes 67.6 na. A "state of the art" preamplifier has been reported for the small sized, low velocity tube with a current noise as low as 0.5 na. Good preamplifiers are available at about 1 na. Relative to the 1 na value, the large area tube illustrates a value almost 70 times larger and a corresponding reduction in the signal to noise ratio.

Clearly, the excessive lag and preamplfier noise must be eliminated for video tubes to be applied, for example, to diagnostic radiology.

The "high velocity" beam reduces the effect of target capacity on lag. The reason can be explained in terms of tube conductance. For the "low velocity" beam, where the sensor-target voltage is small, the current flowing into the target ($I_t$) is given by $$I_t = a \exp^{bV_t} \quad (2)$$

where b=e/kT

T=effective temperature of the cathode responsible for the energy distribution of electrons in the beam. It is in excess of 1000° K.

e=electronic charge k=the Boltzman constant

The requirement that capacity lag be reduced is equivalent to requiring that the target capacity be decreased and/or that the constant b increased. The latter is equivalent to requiring a large value of the beam conductance near the equilibrium potential of the scanned surface. The beam conductance is given by $$dI_t/dV_t = a\, b \exp^{bV_t} = bI_t \quad (3)$$

where $I_t$ is limited since $V_t$ is small in "low velocity" operation b can only be increased by reduction of the effective temperature T.

Recent new designs in electron guns have succeeded in reducing the effective temperature T, but not to the extent necessary for operation with the large capacities inherent in our applications.

In the case of "high velocity" operation, Dresner shows that the beam conductance is given by:

$$\frac{dI_t}{dv_t} = I_b\, \delta \int_{V_t}^{\infty} \frac{N(v)}{v}\, dv \quad (4)$$

where $I_b$=beam current

δ=secondary electron emission coefficient of the sensor-target

N(v)=the energy distribution of the seconary electrons produced at the sensor-target This expression can be simplified to $$dI_t/dV_t = I_b \delta N$$

where N represents the number of electrons effectively collected.

It is clear that this type of operation is not inhibited by a low target voltage and that the beam conductance increases linearly with beam current. The correspondingly causes a decrease in lag, where compared to the "low velocity" case, to a first approximation the capacitive lag is independent of beam current.

Figure 3:
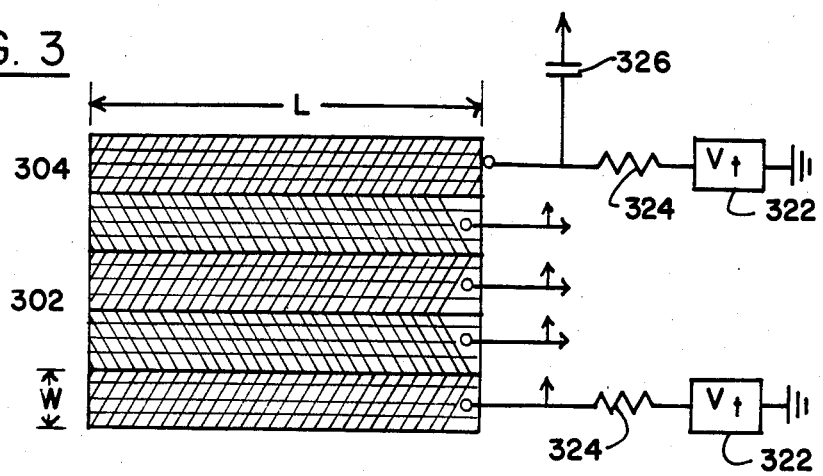
FIG. 3 is an illustration of stripe electrodes each connected to respective circuitry in accordance with the invention.
Figure 4:
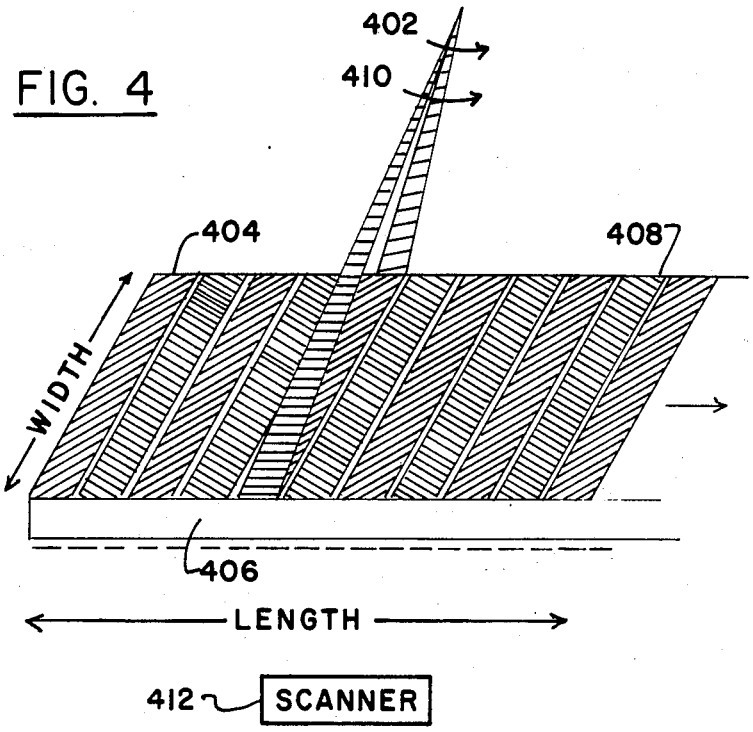
FIG. 4 is an illustration showing a plurality of stripe electrodes being scanned by a fan beam according to the invention.

The dependence of distributed capacity on the area of the sensor-target is dealt with in accordance with the present invention by using stripe electrodes as illustrated in FIG. 3, in conjunction with a fan beam of radiation shown in FIG. 4. The raster lines 302 are shown simply as parallel horizontal lines. The shaded stripes 304 represent electrodes placed one next to the other, spaced so that their separation distance is appreciably less than the vertical dimension of a pixel. Attached to each electrode is a preamplifier circuit exemplified by the load resistors 324, the target bias sources $V_t$ and the coupling capacitors 326. The distributed capacity is now associated with the area of each electrode stripe and the wiring to the preamp. The length of each stripe as shown in FIG. 3 is slightly longer than the length of a raster line. The width encompasses as many raster lines as device capacity and design allows. This number may differ for "low" versus "high" velocity operation because of a "secondary electron" redistribution problem inherent to conventional "high velocity" tubes.

Limiting the distributed capacity for each stripe to that of the 1"×1" area sensor-target referenced earlier, means restricting each stripe to having the same 1 square inch area. Thus, for a length of sixteen inches, the width must be restricted to 1/16" or 1.56 mm. A 500 line raster spread over 16 inches, would present 31.25 lines/inch, and therefore about 2 raster lines per electrode stripe. For 1000 and 2000 TV line rasters, the number of lines per stripe would grow to 4 and eight, respectively. With this approach, the number of preamplifiers depends upon the number of stripes given by the vertical raster, height divided by a stripe width. For a 16" raster height, and a 1/16" stripe width, the number of preamplifiers equals 256.

Using stripe electrodes to minimize distributed capacity is achievable at the expense of adding a large number of preamplifiers whose numbers can be reduced by multiplexing of stripes. Although, in view of modern integrated circuit techniques such numbers are acceptable, this number can be reduced by exposing each stripe separately with a translating fan beam of radiation, reading out the raster lines beneath each stripe, and then repeating the process for successive stripes. This is a procedure compatible with diagnostic radiology where an X-ray fan beam parallel to the stripes can be made to rotate so that each stripe is exposed and readout in succession, as shown in FIG. 4. This approach permits replacing preamplifiers by switches or multiplexing to the extent that any increase in distributed capacity can allow. Shown in FIG. 4 are the electrode stripes 404, their separation 408, the sensor-target shown here as one layer 406, the X-ray source 402 and the fan beam 410. Although for simplicity the fan beam is shown in rotation, other approaches apply such as translating the X-ray source and fan beam along the length of the sensor-target, or for a fixed position fan beam and X-ray imager translating the object. Not shown in FIG. 4 is the overlaying support structure shown in FIG. 1 as 102. The scanner 412 is identified as the means to charge the inner-scanned surface of the sensor-target.

The invention described to this point can apply equally well to the large area "high" or "low" velocity tubes. The sensor-target stripe capacity and the distributed capacity can be made essentially the same as for those found in conventional, small dimension video tubes. Thus, this invention demonstrates that the "low velocity" electron beam scanner can be used for X-ray diagnostic radiology, when coupled to this invention comprising electrode stripes with associated preamplifiers, a translating fan beam and associated switching or multiplexing circuits.

However, the high velocity beam offers the opportunity for increased target capacity without a corresponding increase in distributed capacity. This approach permits extending the dynamic range of the video sensor, since such range depends upon the magnitude of the charge that can be stored on the target, and the ability of the electron gun to read out totally that charge. The "high velocity" tube offers this improvement over the "low velocity" tube and without suffering additional lag. Thus, for example, a porous layer of trisulfide target of 1000 picofarads could be replaced by a thin amorphous layer of 10,000 picofarads permitting a corresponding increase in the magnitude of the signal that can be managed. Furthermore, the thinner layer offers improved spatial resolution from the target with increased sensitivity.

The principal disadvantage of the "high velocity" tube is in the redistribution of the secondary electrons. When secondary electrons emerge from a surface, they emerge in a range of velocities and angles according to the expression $$R = \frac{2\,md}{e(V_t - V_c)}\, v^2 \cos\theta \sin\theta \qquad (6)$$

where:

R is the distance traveled from the point of emission on the surface of the target to the point of landing, if not collected by the mesh d is the target to mesh spacing m is the electron mass e is the electron charge v is the electron velocity $\theta$ is the emergent angle of an electron trajectory relative to the normal to the surface $V_t$ is the potential of the scanned surface of the sensor-target $V_c$ is the potential of the collector It is clear that many electrons return to the surface and as a result diminish the quality of any electronic image stored on the scanned surface. If the device is operated in darkness and equilibrium conditions prevail, then a relatively constant secondary current reaches the collector equal to the beam current and a fairly constant secondary flow of secondary electrons falls back on to the surface of the sensor-target. In this case, the signal current is zero excepting for non-uniformities in charge distrubution associated with shading, target surface defects and other possible spurious signals. On exposure, the charge distribution is modified dependent upon the photoconductive response, pixel by pixel, in accordance with the projected incident image. Thus, the potential of each individual pixel is shifted accordingly. As the scanning recharges successive elements, the capacitive output signal current is largely neutralized by the return of the secondaries to other target areas, thus limiting the output signal to 25% of the level possible if all secondaries were collected.

Another problem is associated with collector geometry which in the conventional "high velocity" tube leads to a serious degree of shading.

It is possible, furthermore, to have secondary emission from the collector mesh made deliberately dominant over that from the target. This results in mesh controlled range of secondary electrons being reduced to a value of R/2 and in improved contrast. Further reduction in R is possible by close spacing of the collector mesh.

The problem of redistribution effects in large part were dealt with by operation with mesh controlled secondary emission and close spacing between a fine mesh and the target surface.

Figure 5A:
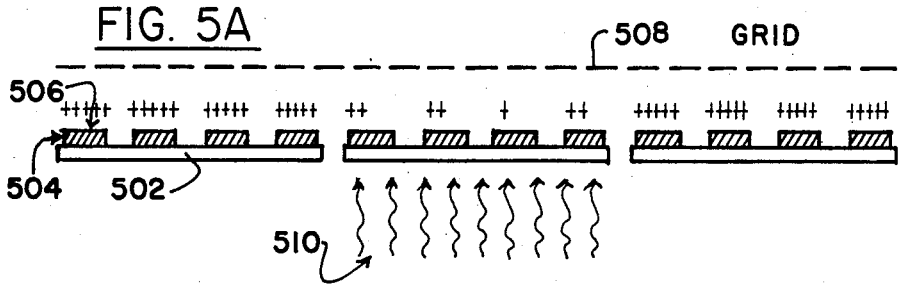
FIG. 5*a* is an illustration showing reduction in positive charge along a stripe electrode when exposed to input radiation.
Figure 5B:
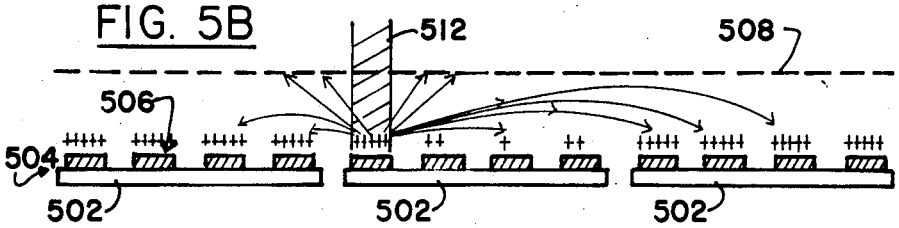
FIG. 5*b* is an illustration showing secondary electrons, generated during readout, being drawn away from the stripe which has undergone a reduction in positive charge.

With the approach described in the present invention using stripe electrodes, additional means for minimizing redistribution effects is possible. For example, the raster lines adjacent to three stripes can be scanned in a manner designed to erase charge stored as a result of prior imaging or redistributed secondary electrons. When the inside stripe is exposed by a fan beam, then a new imaging charge distribution occurs along the lines within the stripe which results in the potential along the lines being depressed relative to these in the two surrounding stripes. Accordingly, there is a strong electric field set-up between the lines within the center stripe and those within the neighboring stripes. Then on scan readout of the lines within the exposed center stripe, the secondary electrons are drawn off either toward the collector or toward the adjacent strip and few electrons fall back on the lines within the exposed stripe. As a result, the signal readout is optimized by minimizing the dramatic signal loss associated with charge redistribution in conventional operation of a high velocity tube. The approach is illustrated in FIG. 5 with three stripes 502, the sensor-target 504 and four scan lines per stripe 506. Each scan line is represented by a shaded region supporting a charge distribution. The center stripe shows a reduced positive charge distribution because of exposure in FIG. 5*a* by X-rays 510. Accordingly, there is an electric field set up between the center stripe and its neighbors to draw away any secondary electrons from the center stripe generated during read-out. This is shown in FIG. 5*b* where the electron beam 512 scans the first of four lines with a stripe. The trajectories of the secondary electrons are shown going to the collector grid 508, the lines in adjacent stripes and a few falling back on a line within the exposed stripe. Not shown is the structure supporting the sensor-target corresponding to 102 in FIG. 1.

The procedure to expose and read out a full raster involves repeating the process shown in FIG. 5 in sequence until all stripes are individually exposed and read out.

Another procedure for reducing the effects of redistrubution is to switch biases on the stripes. In this case, the stripe to be exposed is made to be even further negative compared to the others described above. The sequence of events is then erase, expose and read out a stripe. During readout, the secondary electrons generated are collected by the mesh and the surrounding stripes. The magnitude of the signal is then determined by the exposure reduced only by the few electrons that might fall back on exposed lines.

One can readily conceive of other scan procedures using more or less stripes and more or less lines per stripe. They all fall within the essence of this invention designed to optimize the drawing away of secondary electrons from the exposed stripe during a readout.

It is clear that the high velocity tube operating with stripe electrodes offers the advantages of 1. Minimal lag
2. Optimum spatial resolution in the sensor-target
3. Increased dynamic range
4. High Detective Quantum Efficiency (DQE)
5. Electronic Noise for the large diameter tube can be the same as for the small dimension, conventional low velocity tube.
6. High signal levels. By generating a video signal at the sensor-target using the combination of a beam scan with the stripe electrodes, the modulation transfer function approaches that of the sensor-target.

Finally, the technique of exposing a stripe with a short burst of radiation followed by immediate readout shortens the time requirement for sensor-target storage. This offers an opportunity for wider choice of sensor-target materials with somewhat lower resistivities compatible with the shorter storage time required. This could make easier the possibility of acquiring a sensor-target offering photoconductive gain.

The number of stripes and associated preamplifiers is based on the assumption that the distributed capacity grows in proportion to the area of the sensor target. This is not necessarily the case in comparison with target capacity which clearly grows directly proportionate to area. With "high velocity" operation, considerably more target capacity can be tolerated, since the price of "increased lag" does not apply as it does for "low velocity". The price for large distributed capacity is incrased electronic noise associated with the preamplifier. If, for example, the distributed capacity can be made to grow slowly with area, then the stripe widths can be increased, the number of stripes and correspondingly the number of preamplifiers reduced.

Gain before readout remains an important factor in determining ultimate design of an X-ray sensitive video camera tube. At present, the principal mechanism for obtaining such gain is with a luminiscent layer such as CsI, which generates about 1000 light photons per absorbed X-ray photon. In theory, based on energy considerations of the light photon versus the X-ray photon, one might anticipate that ideal conversion would offer 15 to 20 times more light photons. Gain lead to an improvement in signal and the signal to noise ratio (relative to distributed capacity induced noise). Correspondingly, an X-ray sensitive photoconductor offering a similar range in gain from photons directly into charge carriers would provide the same advantages in signal and the signal to noise ratio. With such improvement, the design can tolerate wider stripes, more raster lines per stripe and fewer preamplifiers. With the high velocity tube there is the negative effect of some loss of image contrast due to recording an increased number of scattered events. Channel multipliers may also be employed to reduce the number of stripes required.

Another approach to relieving the problem of distributed capacity is to improve the signal by adding photoconductive gain in the sensor-target. There has been evidence of such gain in tubes such as the Chalnicon and Newvicon. However, these designs did not require high gain for their application. Earlier attempts to incorporate gain were unsuccessful for operating under the condition of "space charge" limited currents. Recent experience has shown the existence of high gain, high resistive photoconductors suited to video applications. These permit lifting the signal level of photons as high as hundreds. Their performance will be described in detail in the sections below related to operation with DELST devices.

The "high velocity" tube discussed above has been described with the usual raster dimensions of a conventional video tube. However, the principle of operation applies even better to a line sensor shape, as compared to an area sensor-raster shape. A line sensor for example, can be matched to an X-ray fan beam of radiation. The fan beam and line video sensor can then be translated in unison in a direction perpendicular to the plane defined by the fan beam and line sensor, to provide an image covering the area defined by the length of the sensor and the distance it is moved. This technique is well established in diagnostic radiology, but suffers in part from the nature of the sensors used in that application. Both the "high and low" velocity beam operation can operate with a long sensor, whose width is determined by resolution requirements, the number of raster lines required for an application and scatter.

The simplest case is a single raster scan line along the sensor length. In the low velocity case, the device will have low shunting capacity and target capacity limited by the usual requirement on the RC time constant and preamplifier noise. In the high velocity case, the secondary electron redistribution effects become negligible by proper design of the collecting mesh and the device offers the opportunity to use a much larger target capacity, for superior dynamic range. Additional raster lines can be managed within the capacity limits imposed by an application. The advantages gained relate to decreased power requirements imposed on the radiation source (as for X-rays), and more speed in acquiring an image.

The line scanner also offers options in its shape. It can be straight or curved. The latter could have applications, for example, in X-ray radiology to image a cylindrical object with a point X-ray source as in non-destructive testing. An example in medicine is to X-ray the breast with close proximity to the chest wall.

This approach to a line scanner applies with equal validity to versions described below for DELST WITH A SUPER HIGH VELOCITY SCANNING BEAM and DELST WITH A LASER SCANNING BEAM.

2. Operation with DELST and a Super-HIGH Velocity Scanning Beam

A device that can offer the advantages of the "high" and "low" velocity beam tubes without secondary electron redistribution effects, is the displaced electron layer sensor-target. It can be designed to function with either an electron beam or a laser beam.

Figure 6:
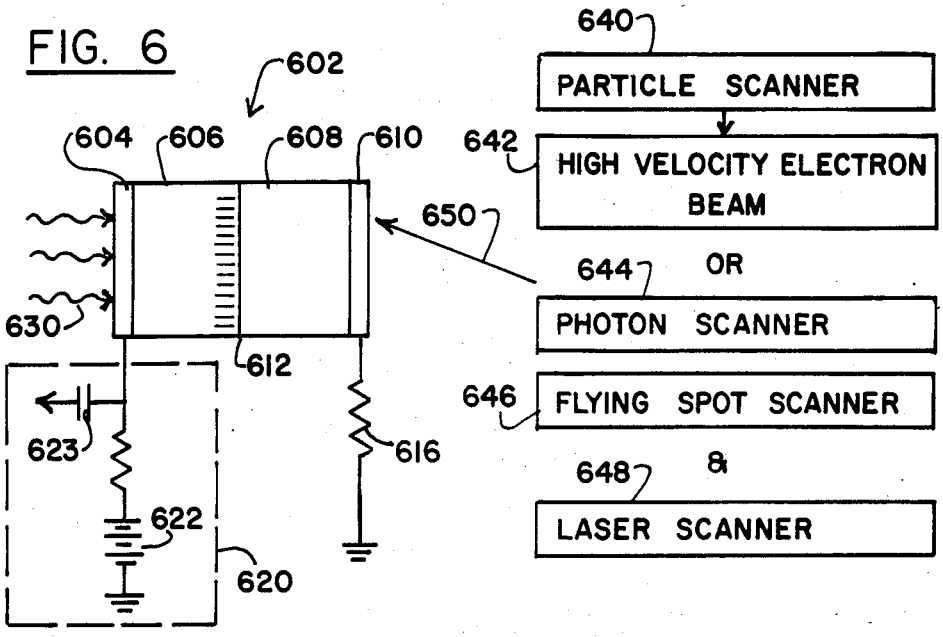
FIG. 6 is an illustration of an embodiment of the invention including a displaced electron layer sensor-target (DELST)

Referring to FIG. 6, a first embodiment displaced electron layer sensor-target (DELST) 600 according to the invention is illustrated. It includes a sandwich structure 602 formed of a first electrode 604, a first layer 606, a second layer 608, and a second electrode 610. The first layer 606 is sandwiched between the first electrode 604 and the second layer 608. The second layer 608 is sandwiched between the first layer 606 and the second electrode 610. Between the first layer 606 and the second layer 608 is an interface surface 612.

The first electrode 604 is connected to a conventional readout circuit 620 that includes a source 622 which positively biases the first electrode 604 relative to ground and a capacitor 623 which carries the video signal to a preamp. The second electrode 610 is connected to ground through a resistor 616.

Also shown in FIG. 6 are the exposure side of the DELST indicated by imaging irradiation 630 directed to the electrode 604, and the charge-read side of the DELST indicated by a scanning beam 650 directed to electrode 610. One mode of operation of DELST can be decribed in the following steps:

1. Use a scanning beam of particles or photons to penetrate electrode 610 and cause the generation of electrons in layer 608. Under the influence of the applied electric field due to the bias 622, the electrons flow to the interface surface where they are stopped and stored.

2. Expose the DELST with imaging irradiation 630 directed at and transmitted through electrode 604, to be absorbed in layer 606. The absorption process leads to a conversion of the imaging irradiation into charge carriers within layer 606 and under the influence of the applied electric field to a depletion of charge carriers stored at the interface surface 612.

3. Use the scanning beam to replace the missing electrons at the interface 612, and in so doing generate a video signal picked up by the preamplifier 620.

Of particular importance in the DELST structure is the addition of layer 608, which makes possible overcoming the disadvantages of low velocity tubes. This occurs because this layer permits operation with a scanning beam of super high velocity particles or an intense scanning beam of photons, without suffering the image degradation of the prior art. In effect the electron storage surface 612 is now buried between layer 606 and 608 and effectively isolated from the source of any scanner electrons, or of unwanted secondary electron emission.

The layers 606 and 608 must have resistivities sufficiently high to permit charge storage, i.e., on the order of $10^{12}$ ohm cm, and is a requirement similar to that for vidicon type tubes. Various multiple layer structures with non-ohmic heterojunctions have evolved over the years to accommodate this requirement as found in the Chalnicon, Saticon and Newvicon. Such junctions can readily be incorporated in layers 606 and 608 if desired.

Electrode 604 is transparent to the incident radiation comprising the image of some object. If the irradiation is light, then the electrode 604 must be transparent to light. If it is X-rays, then electrode 604 must be transparent to these X-rays. Similarly, for energetic particles, such as alphas, betas and neutrons.

Layer 606 correspondingly must be responsive to the nature of the incident radiation. If the irradiation is in the visible range, it must be a photoconductor responsive to light. Similarly, it must have a spectral response matched to the spectra of the irradiation throughout the spectra of interest, which can range from high energy gammas through the ultraviolet, visible and into the near infrared. As one moves to sufficiently long wavelengths in the infrared, this approach must be modified to accommodate the sensors' lower resistivity by providing cooling as needed. Nevertheless, even infrared responsive devices are derivable from DELST sensor-targets. Appropriate materials for layer 606 could include, for example, properly doped germanium or silicon.

The scanner beam 650 as shown in FIG. 6 can be derived from high velocity particles or photons. Particles would be used in combination with a layer 608 selected to provide charge transport or multiplication or both. With multiplication, for example, this could permit a relatively low beam current of high velocity particles to cause a large current scanning beam to flow, in the layer 608, suitable for charging surface 612 and readout with low lag. Most commonly, the particles in the beam would be super high velocity electrons with sufficient energy to cause the required charge multiplication in layer 608. However, energetic beams of other particles such as ions and alphas could also be used for scanning.

When the scanning beam is derived from photons, their source could be from devices such as flying spot scanners using incoherent sources of radiation, or coherent laser raster scanners. The essential requirement is that the flux of photons be sufficiently intense to generate sufficient numbers of electrons in layer 608 so that the charging and reading out functions can be managed properly. When using photon scanners, the layer 608 is made of a photoconducting material whose spectral response is matched to the beam radiation spectrum.

It should be noted that the roles of the charge carriers can be reversed. Thus, if the polarity of electrodes 610 and 604 are reversed then a positive charge is stored at the interface, with electrons and holes moving through layers 606 and 608 in the direction opposite to that described above.

Generally the mode of operation described above with charge multiplication in layer 608 is important when the electron beam current is too small in magnitude to read out the electronic image stored at the interface 612, or when the effective beam impedance needs to be reduced further.

Another mode of operation can be used however, when the electron beam current is well in excess of that needed to read out an image stored at the interface and the magnitude of beam impedance is satisfactory. This can happen when the beam diameter, which grows with beam current, is not limited by the spatial resolution required for the imaging procedure. One task for example, might require a beam current of 0.5 microamps, another twice as much, while still as milliamps. One can anticipate for example, that for an X-ray application in diagnostic radiology, read-out of the electronic image stored at the interface could require 1–2 microamps. A 0.5 microampere beam current clearly would require electron multiplication in layer 608. However, a 5.0 microampere beam current would provide excess electrons and not require miltiplication at all. Accordingly, layer 608 must provide rapid carrier transport to provide instantaneous charging of the interface and draining of excess electrons into electrode 610. It is also possible that in this case of excess beam current, some degree of multiplication could still be beneficial, such as when it results in increased conductivity and affectively reduces beam impedance for purposes of improved lag.

When the DELST operates with excess beam current, there is continual drainage of excess electrons into 610. The reader might be reminded of the mechanism used to read-out the target of the image orthicon. There, the excess beam current remaining after scanning the storage target, was reflected and collected by an electron multiplier-preamplifier located at the rear of the tube. The instantaneous change in the magnitude of the reflected current as the beam scanned the target provided the video signal since it resulted from the electrons given up to the target during read-out of the image. A similar situation exists here in that the current passing through electrode 610 represents the beam current minus those lost to read-out at the interface. Accordingly, another possible mode of operation is to connecty a preamplifier across the resistor connected to the second electrode as a means of reading out the video signal.

The possibility of simultaneously developing a video signal from electrodes 604 and 610 offers the potential for increased signal relative to preamplifier noise in those applications where the preamplifier is the source of limiting noise. For the case whereby the multiplying layer is operating in a minimal gain mode (unity), the interface charging current is derived entirely from beam electrons with no electrons being supplied via bias electrode 610. However, in the case whereby the multiplying layer is operating in a high gain mode, a large portion of the interface charging current is supplied via bias electrode 610. Under these conditions, a second preamplifier could be connected to electrode 610. The output signal from the second preamplifier could be phase adjusted and added to the preamplifier connected to electrode 604. Since both their noises are random, the RMS noise would add in quadrature and the signal would add linearly resulting in an increase in signal to noise ratio.

The layer 608 serves many purposes which can be summarized as follows:

1. It is essential to the formation of the interface required for charge storage which is basic to the DELST invention.
2. It serves as a buffer which provides for response to the scanning beam, the generation of charge carriers as needed and the rapid transport of carriers to the interface 610 and the electrode 610.
3. It supports electrode 610.
4. It has the high resistance essential for charge storage.
5. It provides charge multiplication when essential to device operation with minimal effective beam impedance.

Characteristics required for layer 608 can be found in materials providing secondary electron conductivity (SEC), and electron bombardment induced conductivity (EBIC), which will be discussed below. However, contrary to the way in which these materials function in most video tubes, they can be very usefully incorporated into DELST structures which might require little to zero gain. Furthermore, in conventional video tubes the direction of induced charge flow is usually unidirectional. However, in the DELST structure, when the interface is charging, electron flow is toward the interface. When fully charged, the interface potential reduces to the point where any further charging would drive the interface negative relative to the electrode 610. As a result, excess electrons are then drained off in the opposite direction through electrode 610.

The requirement for the capacity of each of the layers 606 and 608 is based on ensuring that the video signal passing through electrode 604 is not severely reduced by the capacative coupling to electrode 610 through layer 608. This is minimized by causing the capacity of layer 608 to be much smaller than 606, and can be managed by a combination of two effects: First, the thickness of layer 608 can be easily a factor of 20–40 times larger than 606. Second, the dielectric constant of the material in layer 608 can be selected to be a factor of two or more smaller than that in layer 606. As a result, the loss of signal to the preamplifier at electrode 604 is expected to be less than 5%. An example is a combination of a photoconductor whose dielectric constant could be ten adjacent to an SEC layer whose dielectric constant is normally less than five. The photoconductor layer thickness is typically less than one micron, while the SEC layer is 15 microns or more. Another condition imposed ont he selection of materials is that the SEC layer be able to sustain higher field strengths and voltages in order not to limit the charge stored at the interface to unacceptably low levels.

Figure 7:
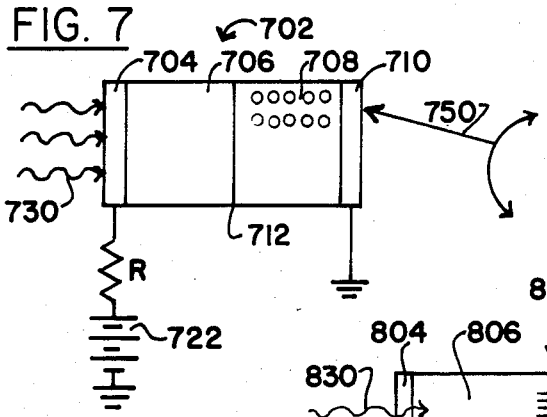
FIGS. 7, 8 and 9 are illustrations showing the effects of impinging input irradiation and a scanning beam on a DELST.
Figure 8:
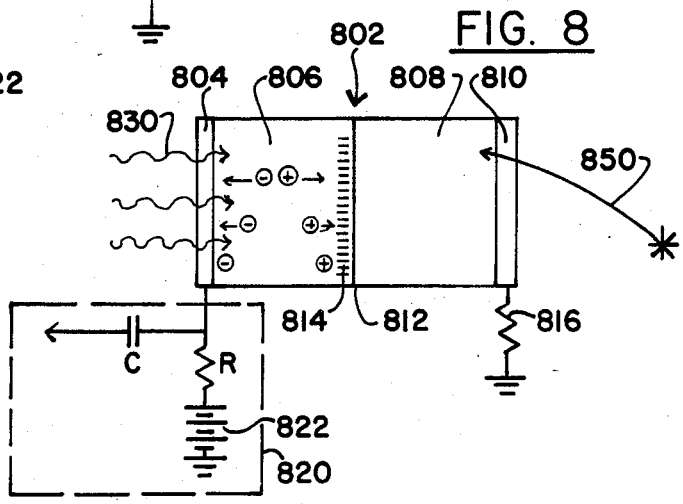
Figure 9:
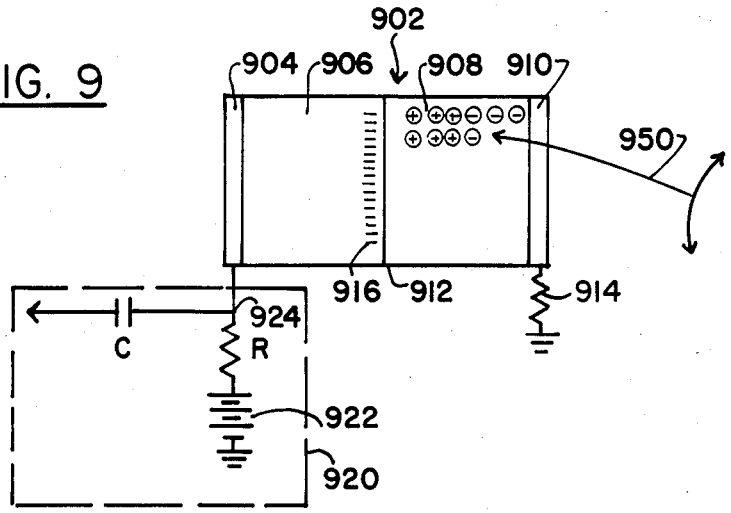

An example that can serve to illustrate a DELST structure and its operation is shown in FIGS. 7, 8 and 9 for imaging with light irradiation and scanning with a super high velocity electron beam, i.e., of kilovolt energies.

When the scanning beam projects energetic electrons through electrode 710, the layer 708 comprises a charge multiplication layer. Accordingly, the layer 708 generates equal or more electrons than are incident thereupon.

Various materials and mechanisms are known which provide this charge multiplication effect. One mechanism is referred to as electron bombardment induced conductivity (EBIC). Typical EBIC materials include semiconducting glass, magnesium oxide, and silicon. When such materials are struck, or bombarded, by electrons of high enough energy (e.g. 10 KeV), electron-hole pairs are generated which exceed the number of incident electrons. A second mechanism relates to secondary electron conductivity (SEC). Potassium Chloride (KCl) is a material related to this mechanism, which is embodied in known SEC tubes. Another type of known charge multiplier is the channel multiplier commonly found in second generation image intensifier tubes. Although different from each other, these various known mechanisms may be employed in the second layer 708 to provide charge multiplication.

The various charge multiplier mechanisms, it is noted, have been used in the image section of conventional low velocity scanner image tubes that incorporate gain. These tubes amplify or intensify the input image, as described above in the background section.

The ideal multiplier layer 708 would simply provide a short circuit between electrode 710 and the interface surface 712. In FIG. 7 is shown the flow of multiplied electrons in an SEC type target, 708, which, under the influence of the electric field, drift toward the interface where they are stored. Optimally, as the super high velocity beam electrons 750 penetrate layer 708 by passing through electrode 710, they trigger an avalanche of electron flow, affecting a short circuit flow toward the interface 712. Each picture element (pixel) on the interface 712 charges with electrons successively as the beam scans through a raster with each avalanche terminating as the voltage drop between 710 and 712 becomes too small to sustain breakdown. This would ensure the maximum number of electrons available in minimizing time for storage and signal readout. However, such an abundance might not be necessary for the dynamic range required in most imaging applications. Accordingly, EBIC and SEC type materials offer gain extending over a range from 2 to 3000 that might well cover the range needed in general. FIG. 7 is designed to show the beginning of electon deposition at the interface 712 as the raster scan is initiated. Note that although layer 708 is responsive to the high energy beam of electrons 750, it is not responsive to input imaging irradiation 730 passing through electrode 704 and into layer 706. This scanning process results in a uniform deposition of electrons at the interface surface 712.

The input layer 706 is similar to the photoconductive sensor-target of the vidicon type tubes. It can have any of the detailed structures exemplified by the Vidicon, Saticon, Chalnicon, Newvicon, and Silicon Vidicon. On absorption of incident imaging radiation, electrons and holes are created which drift in opposite directions due to the internal electric field established by the bias voltage 622. This is illustrated in FIG. 8. There is shown a charged interface 814 and the movement of holes drifting toward the interface 812. On arrival, they remove stored electrons by recombination. This results in the uniform distribution of electrodes at 812 being modified to form an electronic image reproduction of the optical image. The electrons generated within layer 806 drift to electrode 804 and are removed from layer 806. They do not in this process contribute to the video signal.

Readout of the electronic image 916 is illustrated in FIG. 9, where the super high velocity electron beam 950, in collaboration with an SEC type multiplier layer 908, is shown replacing the interface layer of electrons removed in the imaging process. This is done on a pixel-by-pixel basis during a raster scan, and results in a video signal being picked up by the preamplifier circuitry 920.

Note that throughout the description of this example, the input electrode 904 is electrically conductive while being transparent to the imaging light. Furthermore, the scanned electrode 910 is also electrically conducting while permitting of the scanning electrons into layer 908.

In the description of this example, the process of imaging and readout has been described in sequence. In fact, the process can be managed either in sequence or concurrently, similar to these possibilities for conventional video tubes. The forming of the electron layer may be thought of as charging or recharging the target uniformly to a predefined equilibrium voltage.

Finally it is clear that electrons generated in layer 908 are deposited on the interface surface 912. Ideally they do not penetrate layer 906, at least to the extent that significant video signal is lost. This is managed by the selection of materials in layers 906 and 908 and their treatment during deposition so as to form a blocking layer of the surface 912 preventing movement of electrons from layer 908 into layer 906. This includes the possibility of the blocking layer at 912 being formed of materials other than those found in layers 906 and 908. It constitutes a separate, recognizable layer formed specifically to block the flow of electrons and optimize their recombination with holes generated in layer 906. Such layers are well known in the art.

The electron density pattern is read out over line 924 as the beam 950 scans. This is shown in FIG. 9. Specifically, when the beam generates electrons which are directed toward a portion (i.e., pixel) of the interface 912 where no electron-hole combination has occurred, there is no variation detected at electrode 904. The voltage at the line 924 does not change. When the generated electrons recharge a portion (or pixel) that has lost electrons due to recombination, a surge of current—depending on the level of recombination—is detected at line 924.

Further examination of the sandwich structure 902 reveals that the first layer 906 and the second layer 908 together represent the dielectric between two capacitor plates—namely the two electrodes 904 and 910. Interposed between the two plates (i.e., the two electrodes 904 and 910) is the electronic image layer at the interface 912—displaced from the second electrode 910. Between the interface 912 and the second electrode 910 is a voltage drop $\Delta V$. By selecting the second layer 908 of a material that undergoes avalanche breakdown or other such electronic multiplication when bombarded by electrons from a beam, the voltage drop $\Delta V$ approaches zero between the second electrode 910 and the interface 912 where breakdown has occurred. The minimum for $\Delta V$ is determined by the voltage at which avalanching or charge flow can no longer be sustained.

In accordance with this example of the invention, the electronic breakdown is localized. Specifically, breakdown occurs where the beam 950 causes electrons to be generated at a particular time. Hence, as the beam 950 strikes the second layer 908, avalanche breakdown occurs along a path in the second layer 908 from the second electrode 910 to the interface 912 along which electrons are generated and flow to the interface. Such a path represents a substantial short, and the localized resistance can momentarily approach zero.

With a low intensity, high velocity beam 950, successive portions of the interface 912—whereat target charge is or is not stored—can be simultaneously read out and recharged as required.

In essence, the present invention displaces the image forming electron layer from the equivalent of the second electrode 910—where it typically is positioned—to the interface 912 and achieves charging (or recharging) not with electrons from a low current beam subject to high beam resistance but rather with a larger flow of current generated from layer 908 electrons that avoid the source of conventional beam resistance.

In that beam resistance combines with sensor capacity to determine lag, the reduction in beam resistance permits the sensor-target capacity to be increased without adversely affecting lag. The increased sensor capacity may be reflected in a larger area sensor and/or a a thinner sensor. The larger area sensor permits use of the present invention in a broad range of applications. The increased thinness permits (a) extended dynamic range when the sensor can support increased charge density and (b) improved spatial resolution.

In either case, stripe width and stripe separation may be employed in further overcoming capacitance.

With the bias polarity shown in FIGS. 7, 8 and 9, electron flow is always from the target layer toward the sensor layer. Accordingly, the raster-caused, charge storage resides on the inner surface of the sensor at the interface, or in a special blocking layer. When charge is stored on the sensor's surface, the sensor material must have a high resistivity in the order of $10^{12}$ ohm-cm that is typical for video operation. In this mode of operation, the sensor must serve to detect incident radiation and store charge. Because of space charge limitations, it cannot offer gain.

Reversing the polarity of the bias however, changes the situation dramatically. The high velocity beam scan now results in charge depletion since multiplied electrons now flow out of layer 908 through electrode 910. If the target performs as an SEC layer, for example, electron flow induced by the "high velocity" electron beam flows away from the interface, causing the inner surface of the target to become positively charged. If the sensor is an n type material operating as a depletion photoconductor, the absorption of radiation causes electrons to flow toward the interface and discharge the positive surface of the interface. In this mode of operation, the sensor need not store charge and can have a somewhat reduced resistivity. It now has the opportunity to also provide gain, since space charge limitations need not prevail.

Alternative, flexible schemes exist for applying stripes and their functions. In one possible arrangement, biases can be applied to the stripes, with the video signal picked-off the opposite surface electrode. This offers the advantage of individual bias control, which can be important for optimization in obtaining uniform response, as well as unusual applications. Another arrangement has stripe electrodes on each side of the DELST target, so that individual bias and preamplifier stripes are paired to ensure optimum performance. In all arrangements described above, the stripes can be placed on either the sensor or target surface, being required only to be transmissive to the irradiation at their surfaces.

Figure 10:
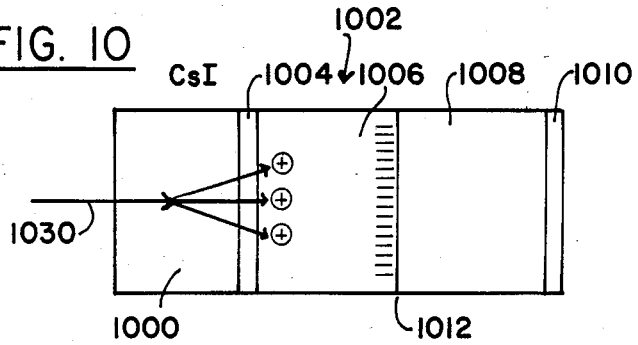
FIG. 10 is an illustration of a modification to the DELST shown in FIG. 6.

Referring now to FIG. 10, a modification is applied to the DELST in 602. Specifically, a light emitting X-ray sensor such as a cesium iodide layer 1000 is positioned between input X-radiation and the first electrode 1004 for another embodiment of DELST 1002. The cesium iodide layer 1000 converts X-ray photons into light photons which pass through the first electrode 1004 to strike the first sensor-target layer 1006. As in the previously described electron scanner image tubes, the second layer 1008 is a charge multiplication layer that forms an interface region 1012 with the first layer 1006.

An electronic image forms at the interface 1012—displaced from the second electrode 1010—as described in the previous embodiments.

In a specific example of an electronic scanner image tube according to the invention, the electron beam has a comparatively low current of one microamp, and the charge multiplication layer has a gain of 200. The target is a conventional material having portions, or pixels, thereof which discharge within $10^{-7}$ seconds. With such parameters, the number of electrons n involved. in current flow i over a time t can be calculated from the equation:

$$i = n/t \cdot e \tag{7}$$

That is, $$\frac{i}{e} = \frac{n}{t} = \frac{10^{-6}\ \text{amp}}{1.6 \times 10^{-19}\text{amp/electrons/sec}} \approx 6.7 \times 10^{12}\ \text{electrons/sec} \tag{8}$$

Over the dwell time $t_d$ of $10^{-7}$ sec, the number of electrons imparted per beam diameter N is:

$$N_b = \frac{n}{t}\, t_d = 6.7 \times 10^5\ \text{electrons} \tag{9}$$

With a gain of 200 in the charge multiplication layer, the number of electrons available to charge (or recharge) the interface is:

$$N_{bg} = 6.7 \times 10^5 \times 200 = 13.4 \times 10^7 = 1.34 \times 10^8\ \text{electrons/beam/diameter} \tag{10}$$

It is essential in reducing lag that there be many more readout electrons available then the number of electrons required to replace those electrons which combine with holes at the interface, i.e., electrons lost in the charge storage surface. An estimate of the charge ratio can be obtained from the beam diameter, the dwell time of the beam, exposure, and gain. By way of example, the specific example is characterized by a beam diameter of 0.016 mm; an input flux of radiation directed toward the first electrode of $2 \times 10^5$ photons/mm$^2$; a sensor detective quantum efficiency (DQE) of 50%; and a pixel area $A_p$ of 0.02 mm$^2$. The number of holes generated per pixel to remove stored electrons is calculated from the expression:

$$DQE \times Input\ Flux \times Pixel\ area = 2 \times 10^3\ holes/pixel \tag{11}$$

Thus, for perfect discharge of a pixel subject to maximum radiation exposure, $2 \times 10^3$ electrons are required.

The flux $2 \times 10^5$ photons/mm$^2$, it is noted, corresponds to the flux available in a typical low light level condition. Also, this flux corresponds to the X-ray flux available in diagnostic radiology in an exposure of 1 mR of 50–60 KeV photons.

The number of electrons per pixel available for charging $N_q$ is then determined from:

$$N_q = N_{bq}\frac{A_p}{A_b} = 1.34 \times 10^8 \times \frac{.02}{8 \times 10^{-4}} \quad (12)$$

$$= 3.35 \times 10^9 \text{ electrons/pixel}$$

The ratio of charging (or recharging) electrons to the number of holes generated in the above exposure is then:

$$\frac{3.35 \times 10^9}{2 \times 10^3} = 1.68 \times 10^6 \quad (13)$$

As noted hereinbefore, when the radiation input is X-radiation rather than light, the scanner image tube includes a light scintillator in the form of a cesium iodide layer. Accordingly, the effect of the cesium iodide layer must be accounted for in the above calculations. The cesium iodide layer is known to generate on the order of 1000 light photons for each absorbed X-ray photon. These light photons are absorbed by the sensor, e.g., the first layer 1006 of FIG. 10, whereupon electron-hole pairs are generated. At a quantum efficiency of 100% for example, 1000 absorbed electron-hole pairs are generated in response to the 1000 absorbed light photons. The number of electrons that combine with the holes conveyed to the interface 1012 through the first layer 1006 thus increases by a factor of $10^3$. Thus, for a pixel, the number of electrons that can combine with holes equals $2\times10^6$. The charge:discharge ratio, i.e., the ratio of (a) electrons directed to a pixel from scanning versus (b) electrons lost through the recombination, reduces to $1.7\times10^3$.

The high charge:discharge ratio results in rapid and total readout and recharge. It is further noted that the ratio can be further increased by increasing the charge density of the beam or increasing the gain in the second layer. In this regard, silicon has been reported with gains as high as 3000.

As an alternative in the X-ray application, a suitable high resistivity photoconductive first layer 1006 that is responsive directly to the X-rays may be employed—thus obviating the need for the additional cesium iodide layer 1000.

A consequence of the high charge:recharge ratio is that the leading edge of the scanning beam is able to effectively cause discharge. The full beam diameter is not necessary for recharge, and the effective MTF of the beam's contribution to spatial resolution is improved.

Another consequence of the DELST electrode configuration is the continuing concern of excess distributed capacity for certain applications. In particular, the target-multiplier electrode connected to ground through a resistor in FIGS. 6–10 might still lead to excess device capacity. However, the electrode can be disconnected from the resistor and made to operate in a floating condition by incorporating a combination of flood gun and bias lighting. These devices function to maintain proper charge balance during the sequence of steps comprising interface charging, exposure and beam scanning, and to set the proper equilibrium voltage across the DELST structure. In effect, the combination of the beams from the flood guns and the super high velocity gun are responsible for maintaining the interface storage charge and the surface storage charge.

The role of the bias light is to provide a drain of electrons away from the multiplying layer and the interface through the photoconductor. This mechanism is to prevent excessive voltage building up across the DELST structure due to the super high velocity beam energy and to establish an equilibrium voltage.

The role of the flood guns is to replace the resistor connected to ground which provided a current flow to the electrode. In combination with the super high velocity scanning beam impacting the multiplying layer and the bias voltage applied to the photoconductors electrode, electrons deposited on the multiplier electrode can be made to drain to the interface.

Figure 11:
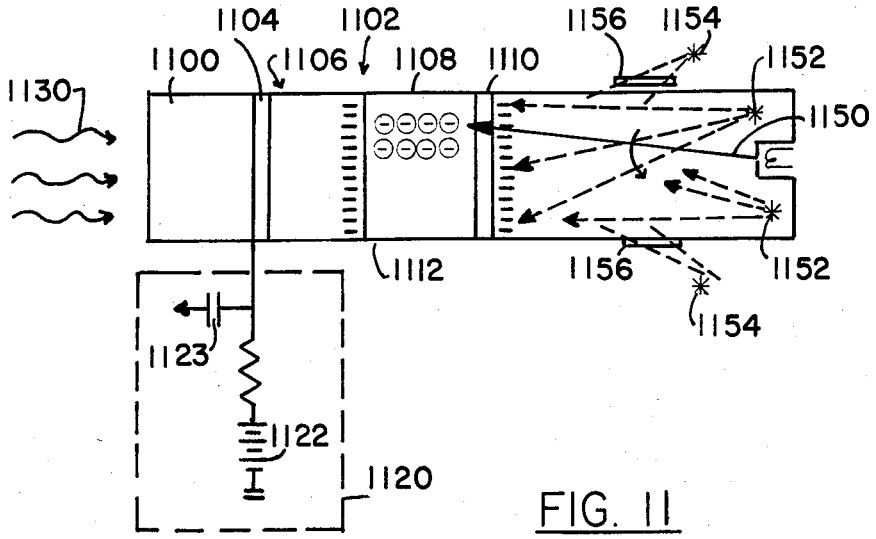
FIG. 11 is an illustration of an embodiment of the invention including a DELST and an optical scanning beam.

The incorporation of a flood gun is managed at the rear side of the tube as shown in FIG. 11, where electrons from the gun can be sprayed onto the electrode 1110. Bias light 1154 can be projected through window 5115*b*, a transparent and/or translucent combined electrode 1110 and multiplying layer 1108, to illuminate the photoconductor 1106. This design is particularly attractive for X-ray sensitive DELST operation, since the front window 1104 may be opaque to light, and similarly the X-ray sensor 1100. For applications involving a transparent window and light sensitive photoconductor, the bias light can also be projected through the window.

The flood guns and bias light can operate continuously or be operated in pulsed mode, depending on the application. One possibility for example, is to pulse operate the flood guns, the super high velocity scanning beam and the bias light. Combined they function to charge the interface 1112 and the electrode 1110 to some equilibrium value during a short period before exposure and read-out. Exposure can follow charging with the super high velocity scanning beam providing signal read-out between the scanning and flood beams. In effect, with this mode of operation, the flood guns and bias lighting provide an electronic switch that permits proper charging and biasing of the DELST, and eliminates noise inducing capacity that could be associated with an electrode attached resistor connected to ground. Other modes of operation are possible, but fall under the realm of this patent when applications are suited to a switching or a continuous operation.

An alternative design to further reduce capacity is to remove the conducting electrode 1110 from the target surface and leave the SEC or EBIC surface exposed. The flood guns function with low velocity electrons and deposit electrons directly on the materials surface. The super high velocity electrons from the scanning gun cause electrons to drain from the surface to the interface. In combination with the bias light, they charge the interface and the exposed surface of 1108 as desired. This process can require repetitious raster scans until the surface and interface charge are fully established at some specified equilibrium.

The operational sequence of expose and read-out can then follow. During exposure with X-rays for example, the flood and scanning guns as well as the bias light can be turned off. Electrons are removed from the interface in the normal photoconductive process with associated carrier transport. The raster scan occurs after exposure wherein the stored surface electrons are caused to drift toward the interface and to participate in the replacement of those electrons lost during exposure. The video signal is generated in this process. In addition, the bias voltage across the signal electrode can be adjusted during the sequence to provide more flexibility in optimizing conditions for interface and surface charging, exposure and read-out of video signal. Furthermore, the beam current can be made larger or smaller to ensure that the proper amount of charge is provided at the interface for pixel read-out. The upper limit being set by the magnitude of beam impedance and associated lag.

3. Operation with DELST and an Optical Scanning Beam

A means for achieving a solid state panel wherein imaging radiation is incident on the front surface and read-out with a laser beam scanning the near surface, is with the use of a DELST structure.

Figure 12:
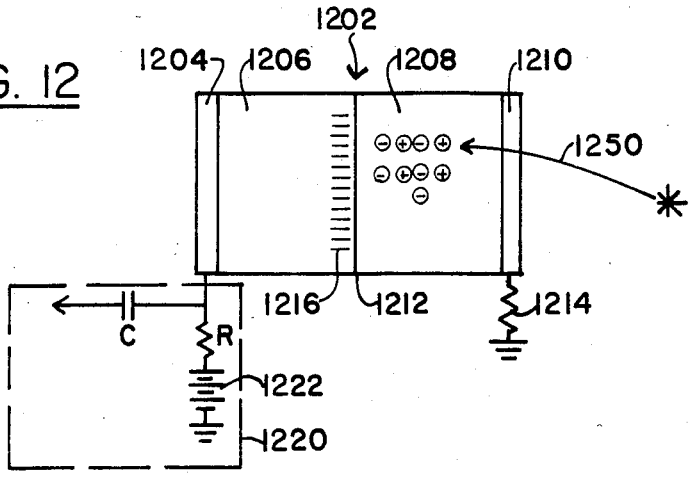
FIG. 12 is an illustration of a prioximity focussed intensifier device employed in the invention.

FIG. 12 shows a further embodiment of the invention. A laser scanner image DELST 1202 includes the first layer 1206 sandwiched between the first electrode 1204 and the second layer 1208. The second layer 1208 is sandwiched between the first layer 1206 and the second electrode 1210. Between the first layer 1206 and the second layer 1208 is an interface region 1212 whereat an electronic image is formed.

Unlike the electron beam scanner image tubes, a laser beam 1250 scans the second electrode 1210 which is transparent to laser radiation.

The first layer 1206 and the second layer 1208 are each photoconductive layers of high resistivity. The first layer 1206 is responsive to incident radiation, e.g., X-radiation, and does not respond to laser radiation. Similarly, the second layer 1208 is responsive to the laser input but is insensitive to the incident radiation. Alternatively, photoconductive layers 1206 and 1208 can be selected and their thicknesses adjusted to absorb the radiation passing through their adjacent electrodes 1204 and 1210, respectively. Such layers ensure that radiation entering a layer through an electrode blocks any transmission to the opposite layer and thus each layer is exposed to only the radiation intended. Finally, it is also conceivable that a light blocking layer can be interposed at surface 1212, while maintaining the prerequisite electronic properties prescribed for DELST operation.

As in the electron beam scanner image tubes, the interface 1212 represents an electron layer displaced from the second electrode 1210. Electrons generated in the second layer 1208 are blocked at the interface 1212. Electrons and holes are generated in the first layer 1206, the electrons moving to the first electrode 1204 with the holes combining with electrons at the interface region 1212 to define a distribution of charges along the electron layer. The second layer 1208 may provide gain, if desired. However, the number of electrons generated by the laser scanner 1250 may create a large enough charge:discharge ratio to enable readout and recharge following electron-hole combining at the interface 1212.

The incident radiation may be light, X-rays, or other radiation. In each case, the first layer 1206 is selected to be responsive thereto—such materials being known in the art.

A sample laser scanner image DELST operates as follows with specified parameters. A 10 mw laser beam provides $10^5/^{hc}\lambda$ photons/sec. For $\lambda=6000$ Angstroms, this equals $3\times10^{16}$ photons/sec. The number of photons available at a pixel with dwell time t of $10^{-7}$ sec is:

$$n_t=3\times10^{16}\times10^{-7}=3\times10^9 \textit{ photons} \quad (14)$$

The number of photoelectrons created by photoconduction in the second layer 1008 is given by:

$$n_e=n_t\eta,$$

where $\eta$ is quantum efficiency of the layer.

For $\eta=$ 100%, $n_e$ne$=3\times10^9$ *electrons.*

For $\eta=$ 10%, $n_e=3\times10^8$ electrons.

The number of electrons, $n_e$, is compared to the photon irradiation effects at the input to the imaging sensor. A typical low light level condition is irradiation with $10^5$ photons/mm$^2$. A pixel of 0.15 mm by 0.15 mm would be exposed to about $10^3$ photons/mm$^2$. Assuming 100% quantum efficiency for the first layer 1206, the ratio of (a) electrons generated by the laser scanner 1250 to (b) the input generated charge for combining is: $3\times10^9/10^3=3\times10^6$ For 10% quantum efficiency the ratio becomes $3\times10^5$. In both cases, we have assumed conservatively that the laser beam and pixel diameters are essentially the same.

As an alternative, the laser scanner imager 1202 may include a cesium iodide layer (see FIG. 10) to convert X-radiation into radiation matched to the first layer (if the first layer is not responsive to X-radiation). In this case, the CsI light photon gain provides a factor of 1000 which reduces the ratio to $3\times10^3$ or $3\times10^2$ for 100% and 10% efficiency, respectively.

By way of comparison, a conventional low velocity, electron beam operating with light and a similar pixel size and dwell time, and a beam current of 2 micoamps provides a charge-discharge ratio of $10^3$. This ratio, it is observed, is quite small compared to present invention embodiments having light radiation input and is, in fact comparable to the ratio for X-ray input.

The charge:discharge ratio may be enhanced as desired by increasing the laser power, increasing the dwell time, and/or providing gain in the second layer 1208 as in the electron beam embodiments.

The term photoconductive layer, it is noted, is used in a generic sense to include one or more layers of material having structures such as intrinsic, p-n, and/or p-i-n layers to provide a photoconductive effect with associated properties such as high impedance, good spatial resolution, and good speed of response. It applies also to heterojunctions from dissimiliar materials.

It is additionally noted that by employing electron beam or laser beam raster scanning, the present invention achieves high spatial resolution and an enhanced MTF. Moreover, the fixed potential electrodes combine with the high charging electron numbers to greatly reduce electron beam shot noise of prior art devices, since depleted charges are completely replaced.

Note that if the bias is reversed, and the laser scanner is trained on an n type low hole mobility semiconducting target, electrons will flow away from the interface through electrode 1210 leaving the target with a residual positive charge. When the charge is stored in the target, the sensor need not face space charge limited performance and can provide gain as described earlier for the "super high velocity" electron beam scanned DELST.

Figure 13:
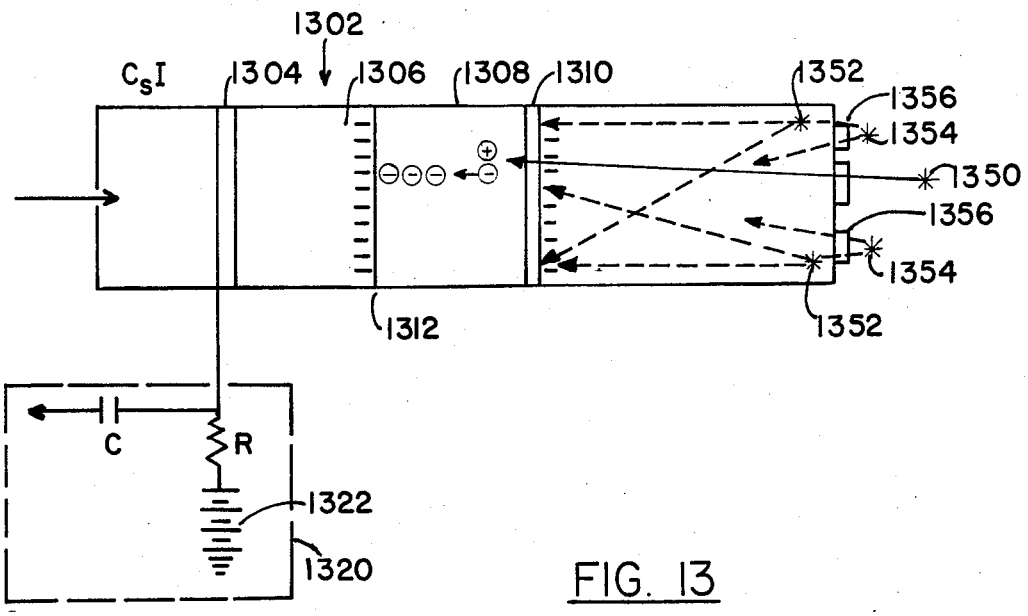
FIGS. 13 and 14 are illustrations showing embodiments of the invention including channel multipliers.

The possibility exists of excessive noise associated electrical capacity with the structure shown in FIG. 12 for certain applications: The reasons are similar to those that applied to the electron tube devices depicted in FIGS. 6–11. A solution to such a problem involves the use of flood guns and bias lighting in the manner that was described above with the super high velocity tube operation. In this case, the DELST structure would be enclosed in a vacuum container that could include one or more flood guns 1352 as in FIG. 13. The container design would then provide for optical windows 1356 at the rear and sides through which the laser scanner and the bias light source located outside the container could illuminate the target.

In the same manner as was described above for operation with the super high velocity beam, the surface of the target 1308 could be covered by a transparent electrode 1310, or be designed to function without the electrode. The flood guns would irradiate the electrode 1310 or the bare surface of the target 1308 with low velocity electrons according to the structure selected. Charging of the interface would be managed by the combined activity of the flood beam and the laser scanner, wherein the electrons deposited on the surface of the target would drift to the interface via the photoconductive response of layer 1308 to absorption of the laser light.

With this device, there is more flexibility in the continuous operation of the flood beam. The laser scanning beam photons and the flood gun electrons function independently. Thus for example in diagnostic radiology, an interface equilibrium charge would be established with continuous flood beam operation and simultaneous laser scanning. Exposure would follow while the scanner was inoperative. The flood beam could continue to operate without concern since during exposure only interface electrons are affected and removed. Those deposited on the surface do not effect the electronic image formed at the interface. Operation of the scanner for a frame after exposure results in charge at the surface drifting to the interface and replacing the missing electrons, and in the process generating the video signal. Again, as noted earlier for the super high velocity electron beam mode of operation: There is also additional flexibility in adjusting the bias 1322 to optimize performance in the sequence for charging the interface, exposure and signal read-out.

Finally, it should also be noted again that the laser scanned DELST structures of 1202 and 1302 can also deal with excess capacity relative to preamplifier noise with the use of stripe electrodes in the same manner as described earlier for the super high velocity tube.

There have been many variations of large panel solid state structures invented for the purpose of imaging with X-rays. These have failed in general to meet the needs of diagnostic radiology. This has been the result of several factors, particularly in avoiding the large noise inducing electrical capacity. In the case of the selenium plate, there was also the difficulty of manufacturing blemish free layers with acceptable yield. Our invention differs by incorporating two active, photoconductive layers and providing means for avoiding capacity related noise. In addition, it makes use of materials such as cadmium sulfide which have been made blemish free in suitably large areas.

4. Large Area DELST Video Imagers

The large area DELST application is typified by diagnostic radiology, and in particular to X-ray imaging of the adult chest or abdomen. The conventional X-ray film size for such applications is 14"×17," or 238 square inches. This large area provides a formidable problem for imaging with a low or a high velocity image tube. In the low velocity tube, it is necessary to overcome large target and distributed capacities. In a conventional high velocity tube where bias is in the order of a hundred volts, distributed capacity is as much a problem, and in addition charge redistribution effects must be minimized if not eliminated. The structure of DELST is designed to eliminate the effects of lag from target capacity and low sensitivity from secondary electron redistribution.

The effect of distributed capacity can be minimized when using "super high velocity" type electron beam scanning (kilovolt range), which makes use of display electron-optics. The field and suppressor meshes of low velocity tubes, which are close to the target surface and are principal sources of interelectrode capacity and thus are a source of preamplifier noise, are eliminated. The remaining distributed capacity related to electrodes are associated with electrodes on the inner wall of the tube, and as such is small. Furthermore, its increase with tube dimensions approaches linearity with increasing sensor-target diameter, rather than its square when proportional to area.

In the case of laser scanner operation, the electrodes associated with electron optics do not exist and correspondingly that source of distributed capacity disappears.

The use of stripe electrodes was implemented as a solution to the problem of distributed capacity in dealing with conventional "low" and "high" velocity tubes. This approach can also be applied to the DELST structure to the extent that capacity remains a problem in any particular application.

Consider the large area of 16"×16" (400×400, $mm^2$) intended for diagnostic radiology. There are two ways to provide a successful X-ray DELST imager. The first is to generate sufficient signal gain and the second is to minimize any DELST distributed capacity (and its associated preamplifier noise). If, for example, the gain can be increased by a factor of 200 or more, the signal grows by a factor equivalent to the increase of noise due to distributed capacity in going form 5 to 1000 picafarads. Correspondingly, the signal to the associated preamplifier noise ratio remains the same, which is a design goal to provide a successful operational device. Decreasing capacity can be managed to some extent by the two layer DELST, which offers some opportunity to control the capacity between electrodes 604 and 610 by selecting materials for layers 606 and 608 with optimized dielectric constants and layer thicknesses.

Another approach to reducing distributed capacity is with the use of flood guns and bias lighting, as discussed in section 3 above. These permit the electrode 610 to be disconnected from a source of potential or ground. The electrode 610 potential now floats. The interface charge, electrode charge 610 and surface potential are now controlled by the flood beam, scanning beam, bias lighting and bias on electrode 604.

5. DELST with Increased Gain

There are two principal ways in which to provide increased signal gain. The first is to use a photoconductor 606, as in FIG. 6 responsive to the incident photons or as layer 1006 in FIG. 10 responsive to the light from the X-ray sensor 1000, to provide substantial photoconductive gain. The second way to provide gain is to use an intensifier placed before the DELST structure. For example, in the high or low velocity electron beam types of video tubes, forefront intensifiers have been incorporated in the image orthicon, image isocon, SEC and SIT tubes, with target gains ranging from as little as 2 or 3, to as much as 3000. The use of a DELST structure to replace these targets requires that layer 606 in FIG. 6 be responsive to imaging energetic electrons, such as materials used for EBIC and SEC targets. However, forefront intensifiers can also include Generation I, II and III intensifiers optically or fiber optically coupled to the DELST target, wherein the layer. 606 would be photoconductive.

Channel multipliers incorporated into proximity focussed intensifiers are also applicable when coupled to the input layer 606. Channel multipliers have also been made to be directly responsive to incident radiation and. can avoid in some cases the need for a photoemissive photosensor arranged with proximity focussing before the input surface of the multiplier. The output surface would traditionally be placed for proximity focussing of exiting electrons to impinge on layer 606 through the electrode 604, where layer 606 would comprise an EBIC or an SEC material.

For relatively low gain requirements, the channel multiplier can be eliminated and the simplier, less expensive one or two stage proximity focussed intensifier can suffice. A simple one stage device would consist of a photoemitter placed before and in close proximity to electrode 604, which would be selected to permit electrons to pass through into ther EBIC or SEC layer 606.

Figure 14:
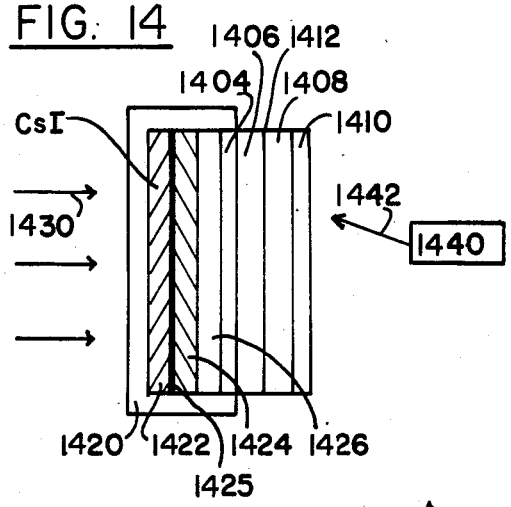

The geometry of proximity focussed intensifier devices shown in FIG. 14 is particularly advantageous for application to large area devices, such as required for diagnostic radiology. There a typical sensor would be a layer of CsI, on which was deposited a photoemitter such as CsSb. The emergent photoelectrons could then impact electrode 1404 directly or through a channel multiplier. The total structure would comprise a metal cap 1420 transparent to incident X-rays 1430, whose inner surface would support the CsI and CsSb layers 1422 and 1424 respectively and be proximity focussed through the vacuum space 1426 to the DELST structure as shown in FIG. 14—an electrode 1425 is located between the CsI and CsSb layers and is held at a negative potential relative to electrode 1404. With this approach, electrode 1404 would permit photoelectrons to pass through an impact layer 1406, which could be either an EBIC or an SEC layer. The raster scanner 1440 could be a source of a high velocity electron beam 1442 which would pass through electrode 1410 and impact layer 1408 functioning as an electron multiplier. The interface 1412 supports the electron layer for image reproduction as described earlier. In this arrangement, the bias is reversed to expedite electron flow through layer 1406 to the interface.

Alternatively, the raster scanner 1440 could be a source of laser radiation 1442, which would pass through electrode 1410 and be absorbed by a photoconductor in layer 1408. Again an interface surface 1412 serves to support the electronic imaging layer.

In arrangements with the channel multiplier serving to provide gain of an imaging signal, the bias must be arranged so that the first electrode 1404 is biased negatively with respect to electrode 1410. This ensures that the photo-emitted and multiplying electrons drift toward the interface. Furthermore, holes generated in a semiconducting solid state EBIC layer 1408 created by the electron beam or laser beam from the scanner, will also drift toward the interface, as required to discharge the imaging electrons in generating a video signal. The mechanism differs with the SEC type of layer, where the interaction at the interface only involves electron flow, discharging through the SEC layer.

The channel multiplier when operating with a relatively low gain requirement offers the potential for very useful design advantage. For example, in applications where the input window can be rigid and strong, the channel multiplier need not be self supporting. The input window can be used to support all device layers, and thereby offers more flexibility in acquiring an appropriate multiplier structure. Multipliers can be designed to function for example, without the difficult requirements imposed in large area applications for rigidity and sturdiness. Since they would essentially lie against the sensor which in turn would be supported by the input window, the multipliers need not be self supporting. They could be optimized for spatial resolution and gain. This could be done with far less concern for mechanical properties the multiplier must possess as in proximity focussing or whether it be made of metal, glass or any other suitable substance. Fragility and rigidity simply become far less severe requirements with this design. Examples of input windows that could apply here would be metal discs as used in X-ray imaging or glass discs as used in imaging with light.

Figure 14A:
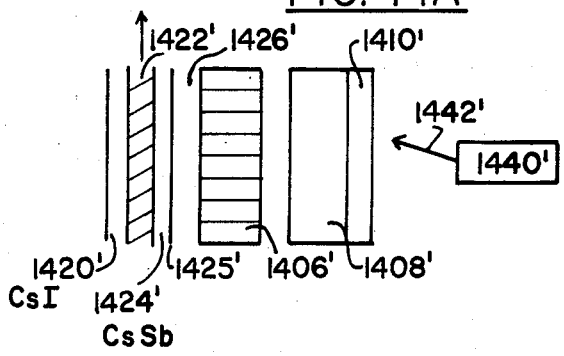

A generalized arrangement that utilizes the channel multiplier is shown in FIG. 14*a*. This figure illustrates the channel multiplier arranged to be separated from the scanned layer 1408' and the photoemitter 1424' by a vacuum space 1425'. The separation cn either side, if sufficiently wide, permits incorporatior of electron optics as used in the Generation I image intensifier, and if sufficiently thin, can function with proximity focussing. Furthermore, the photoemissive layer 1424' can be deposited on the input side of the channel multiplier. Another option is to eliminate 1406' and place the channel multiplier in contact with layer 1408'. Clearly the device can function with any of these arrangements, i.e., with or without separation on either side of the channel multiplier relative to the appropriate layer 1424' or 1408', and thereby offers the opportunity to select the arrangement that best fits any one application. For example, in large diameter X-ray imaging, the opportunity to support the channel multiplier against another surface reduces the need to make the channel plate rigid and inflexible.

The options available for layers 1406 and 1408 are desirable for maximum versatility, i.e., either could be a photoconductor or a charge multiplying layer. Thus the designer, given the nature of the incident radiation, the cross-sectional area of the device and its imaging requirements can seek to optimize system performance by judicious choice of all components in FIG. 14.

Gain achieved through the use of photoconductive gain in layer 1006 of FIG. 10 is the simplest and most desirable method and should be used whenever possible. It reduces the number of components required for the device and thereby its size and cost.

With reference to X-ray imaging, layer 1006 in FIG. 10 can be managed with a material such as ZnCdS or even CdS, which have been developed with high resistivities. A specific example of a CdS sputtered film developed by Bell Laboratories, was reported to have in a specific application, a gain of 750, a photoconductive rise and decay time of 150 and 50 sec, respectively, with dark resistivities in the range of $10^{10}$–$10^{11}$ ohm cm, and a ratio of dark to light resistivity of $5\times10^4$. These characteristics are important for DELST operation, since even though reamining distributed capacity is reduced, any residual capacity induced preamplifier noise can be overcome by this magnitude of photoconductive gain. For example, if the noise is increased by a factor of 100–200 and a gain of 750 were incorporated in the DELST photoconductor, the resultant performance would not suffer from any distributed capacity induced preamplifier noise. For the case of a device using display electronoptics with a "super high velocity" scanning beam, the distributed capacity is expected to grow, at worst, approximately linearly with diameter. Accordingly, an increase in diameter should see a 20-fold increase in noise associated with going from a 1 inch to a 20 inch tube. This could well be in the order of "state of the art" preamplifier noise, so that only a small gain, if any, need be included. Nevertheless, for unforseen circumstances, the order of gain available provides solutions to any distributed capacity problems that might arise.

In practice, gains as high as one million were achieved at the Bell Laboratories with CdS for resistivities in the range of $10^7$–$10^8$ ohm cm. As stated before, in the mode of operation for DELST where charge-storage resides on the target, it is possible for the sensor to have lower than customary resistivities. Since gain improves with reduced resistivities, this mode of DELST operation becomes particularly attractive for possible low light level applications, and for reduced lighting requirements in conventional TV applications.

Other photoconductors and other gains are possible, so that the characteristics for layer 606 can be tailored to match the multiplier or photoconductor in layer 608.

Implications of a high-gain, sensor-target extend to a very favorable high level of signal current. Compared to a vidicon tube operating with hundreds of nanoamperes, the DELST offers signal current in principal up to hundreds of microamperes and with more gain to milliamperes. The result is that the preamplifiers attached to stripe electrodes become much less sophisticated and far less expensive. Furthermore, it permits reduction in stripe numbers through the use of wider stripes and/or multiplexing. Finally, since there are secondary electron redistribution effects, it makes the use of simultaneous multiple fan beam exposures easily possible for diagnostic radiology, permits more scan lines per stripe as well as wider stripes. Using multiple fans results in reduction of the total time required to expose the full surface of the object and sensor-target and minimization of imaging X-ray scatter. The number of fan beams is thus determined by the spacing required between fans to ensure that scatter from one fan does not fall on the sensor-target exposed by an adjacent fan; and also by the length of the sensor-target being scanned. Thus, for a length L for the sensor-target and a spacing S, the number of fans become L/S. The DELST stripes between fan beams are turned off during exposure to avoid their recording X-ray scatter.

A specific example illustrates the perfomance possible from a DELST designed for diagnostic raidology. Assume a worst case with the following conditions where the distributed capacity is taken equal to a stripe capactity:

| Sensor-Target Layer 1006 |
|---|
| $Q.E._s$ = Quantum Efficiency = 100% |
| $G_1$ = Gain (Photoconductive) = 750 |
| E = Exposure 1 mR with Average Photon Energy |

-continued

| Sensor-Target Layer 1006 |
|---|
| Equal 60 keV = $3 \times 10^5$ photons/mm$^2$ |
| $G_2$ = Gain in layer 1000 of FIG. 10 CCsI) = $10^3$ |

| Photoconductive Layer 608 in FIG. 6 |
|---|
| $Q.E._p$ = Quantum Efficiency = 100% |
| $G_3$ = Gain - Unity |
| $P_L$ = Laser Scanner Beam Power - 10 mW |
| $\tau$ = Dwell Time/Pixel - $10^7$ sec. |
| $N_{pE}$ = Photoelectrons/pixel within a dwell time = $3 \times 10^9$ (see Equation 13) |

| DELST | | |
|---|---|---|
| A = | Surface Area = | $400 \times 400$ mm$^2$ = 16" × 16" |
| a = | Stripe Area = | $4 \times 400$ mm$^2$ |
| $C_s$ = | Stripe Capacity = | 3000 picofarads |
| l = | Thickness between Electrodes = | microns |
| $\rho$ = | Average Resistivity between = Electrodes | $10^{11}$ ohm-cm |
| $V_B$ = | Bias Voltage = | 35 Volts |
| $P_r$ = | Pixel Resolution = | $0.1 \times 0.1$ mm |
| NRL = | Number of Raster Lines = | 2000 TVL |
| $L_D$ = | Raster Line Desity = | 5 lines/mm |
| $L_S$ = | No. of Raster Lines per Stripe = Width | 20 lines |

With the above conditions, DELST performance can be predicted as follows:

1. Video Signal ($S_v$)

$$\begin{aligned} I_v &= E \times QE_s \times G_1 \times G_2 \times P_r/\tau \\ &= 3 \times 10^5 \times 1750 \times 1000 \times (0.1 \times 0.1)/10^{-7} \\ &= 3 \times 7.5 \times 10^{5+2+3-2+7} \\ &= 2.25 \times 10^{16} \text{ electrons/sec} \\ &= 2.25 \times 10^{16} \times 1.6 \times 10^{-19} = 3.6 \text{ ma} \end{aligned}$$

This current is unusually high and indicates the extent to which gain selection is flexible.

2. Noise in Signal (RMS)

$$\begin{aligned} I_N &= \sqrt{E \times QE_s \times Pr}\ G_1G_2/\tau \\ &= 55 \times 750 \times 1000 \times /10^{-7} \text{ electrons/sec} \\ &= 5.5 \times 7.5 \times 10^{1+2+3+7} = 4.125 \times 10^{14} \text{ electrons/sec} \\ &= 66 \times 10^{-6} \text{ amps} = 66\ \mu\text{a} \end{aligned}$$

3. The Preamplifier Noise $I_N$ associated with distributed capacity can be calculated from Equation 1 and found to be $$I_{Nd.cap.} = 158.4 \text{ na}$$

This noise is much less than the X-ray noise and thus permits use of even larger DELST capacity, which offers the opportunity to use wider and fewer stripes. The ratio of $I_{nS}/I_{Nd.cap.} \approx 400$, and suggests for the selected operating conditions that the stripes might well be eliminated. Alternatively, the photoconductive gain could be sharply reduced.

4. Power dissipated from bias $P_t$ $$P_t = \frac{V_t 2}{\rho \frac{l}{A}} = \frac{(35)^2}{10^{11} \times 10^{-3/40 \times 40}}$$

$$= (3.5)^2 \times 10^{2-11+3} \times 1.6 \times 10^3$$

$$= 1.96 \times 10^{2-11+3+3+1} = 1.9 \times 10^{-2} \text{ Watt}$$

$$= .02 \text{ Watts}$$

5. DELST Exposure and Read-Out Time Conditions a. Use a single translating fan beam with thickness equal to a strip width.
b. Electrode stripes = 100
c. Stripe width = 4 mm
d. Raster Lines per stripe width = 20
e. Number of raster lines = 2000
f. Raster area = 400 × 400 mm$^2$
g. Pixels per line (digital) = 400
h. Dwell time/pixel - $10^{-7}$ sec.
i. Readout time/line - $4 \times 10^{-5}$ sec.
j. Exposure time/stripe = 3 msec.
A. TIME $T_{stripe}$ to "Expose and Readout" a stripe
$T_{stripe} = 3 \times 10^{-3} + 20 \times 4 \times 10^{-5}$
$= 3 \times 10^{-3} + 8 \times 10^{-4}$
$= 3.8$ msec
B. TIME $T_{raster}$ to "Expose and Readout" entire area of 400 × 400 mm$^2$
$T_{raster} = 100 \times T_{stripe} = 0.38$ secs.

*Note that flyback time is not included in this calculation.

Note that time to readout a raster can be reduced further by multiple fan beams, with and without parallel, simultaneous readout into designated memory. Further, sufficient design flexibility exists for a slower scan readout. This latter readout reduces noise rapidly when associated with distributed capacity since it is proportional to the bandwidth raised to the 1.5 power, i.e., $(\Delta f)^{3/2}$.

C. Time to "Expose and Readout" Using Multiple Fan Beams and Simultaneous Read-Out of Exposed Stripes It is readily possible to use two or more X-ray fan beams for simultaneous exposure of a corresponding number of stripes. For example, two fan beams spaced 200 mm apart at the sensor surface, in simultaneous operation can reduce the time to expose the surface by one-half. Furthermore, if each exposed stripe can be readout in parallel immediately after exposure, the readout time is also reduced by one-half. Since each stripe can have its own preamplifier or multiplexed to a pair of preamplifiers, simultaneous readout is easy to accomplish. Signal output from each preamplifier can then be fed to a line in digital memory, wherein the memory is designed to accept one or more lines in parallel and simultaneously.

With multiple fan beams and simultaneous readout of exposed stripes, the time to expose and readout a raster is given by 0.38 seconds divided by the number of fan beams (using the above conditions)

For two fan beams, $^{T}R.2=0.19$ secs

For four fan beams, $^{T}R.4=0.095$ secs

Correspondingly, the imaging rate is the reciprocal of the above, and with four fan beams, approaches 10 images per second.

Most of diagnostic radiology is carried out below 7.5 frames/sec. Only for studies of the heart and coronary arteries is there a need for real time imaging. Thus with only four fan beams, one exceeds the requirement in speed for at least 90% of diagnostic radiology.

The example cited above applied particularly to the DELST electrode in 610 and 1010 coupled to ground through a resistor. When bias lighting and flood guns are incorporated in the device, additional time is required when used in the pulsed mode of operation. In the extreme, worst case, the charging of the interface and electrode surface associated with each stripe occurs when each stripe is charged separately. The extra time is consumed mainly by the super high velocity beam scanning each raster line within a stripe. For the example cited above with 100 stripes and 20 lines per stripe, the time to charge a stripe would be about 0.0008 seconds and the full raster about 0.08 seconds. For two fan beam operation, this reduces the effective raster rate to about 4 frames per second, and for four fan beam operation to almost 6 frames per second. This time can be shortened by beam broadening to scan multiple lines at a time with continuous operation of the flood gun during the charging process. This would permit increased raster rates as would the addition of more fan beams.

Fan beam projection is also attractive because it provides a means to avoid recording scattered X-rays. This can be managed in DELST operation by making active only those stripes which are being exposed by the fan beams. Stripes located between the fan beams can be inactivated by removing the bias from electrode 1104, or by using the pulsed mode of operation with flood guns and bias lighting wherein each stripe is charged separately, or a combination of both.

6. DELST With Reduced Capacity

The layers 606 and 608 in FIG. 6 can be thought of as two capacitors in series. Thus the capacity between electrode 604 and 610 is less than that of the sensor-target, the extent depending upon the thickness and dielectric constant of layer 608. Reduced capacity means reduced noise associated with the preamplifier. The extent to which this is possible depends upon the extent of increase in bias 622 required to maintain the proper internal electric fields in layers 606 and 608; the ability to maintain a well defined electron beam of small diameter in 608 to hold spatial resolution; maintaining sufficient charge storage for the desired dynamic range; and maintaining prerequisite performance as an electron multiplier. For example, ZnCdS and/or CdS can serve as the photoconductive layer 606, and have dielectric constants that are in the range of 8.37–9.4. The multiplying layer 608 used with an electron beam might comprise KCl with a dielectric constant of 4.64. The combination with thicknesses adjusted for photoconductive bias and multiplier requirements, offer the opportunity to reduce the net capacity, while holding the density of charge in the interface surface 612 to desired levels required for imaging. In the case of the DELST used with a laser beam scanner, an example of materials selection could be a ZnCdS or CdS sensor-target of 1–2 microns thick used for layer 606, to be used in conjunction with a porous antimony trisulfide film as thick as ten microns or more in the layer 608. An advantage to using KCl as an electron multiplying layer or $Sb_2S_3$ as the photoconductor responsive to the laser radiation is that they are relatively insensitive to X-rays. Accordingly, they would not be activated by incident X-rays 630 as would be used in diagnostic radiology. On the other hand, ZnCdS and CdS have been used as X-ray sensors in the past. Accordingly any X-rays penetrating the X-ray sensor layer of CsI 1000 in FIG. 10, and absorbed in the sensor-target layer would only have a favorable effect in total photoresponse. Since the layer 606 here, however, is only a few microns thick, X-ray absorption will be small and any effect on overall device performance will be small.

Unusually high target charge storage requirements can be met with the ASOS photoconductors used by O. Schade, which were capable of 400 times the capacity used in conventional vidicon type sensor-targets.

The effect of capacity reduction by adjusting the individual capacities of layers 606 and 608, and using electrode stripes combine to reduce any potential capacity problem. Nevertheless, it is conceivable for some applications that reduced photoconductive gain in layer 606 and reduced signal current are desirable. This could result in the requirement for substantially reduced capacity beyond that possible by adjusting the dielectric properties of layers 606 and 608, or by further reducing stripe widths. An alternative way to achieve capacity reduction is by insertion of an intensifier such as the channel multiplier already described as a means to achieve gain in lieu of photoconductive gain.

Figure 15:
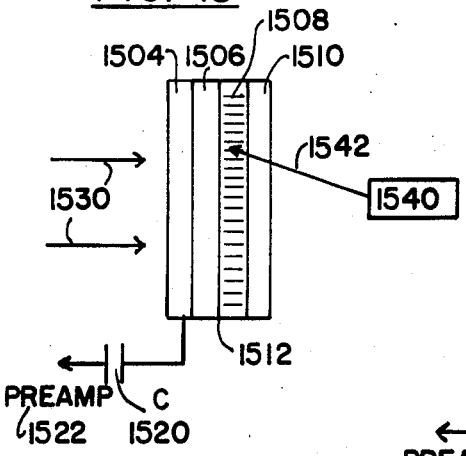
FIG. 15 is an illustration of the embodiment of the invention including flood and super-high velocity guns inside the vacuum enclosure with bias lights positioned outside.
Figure 16:
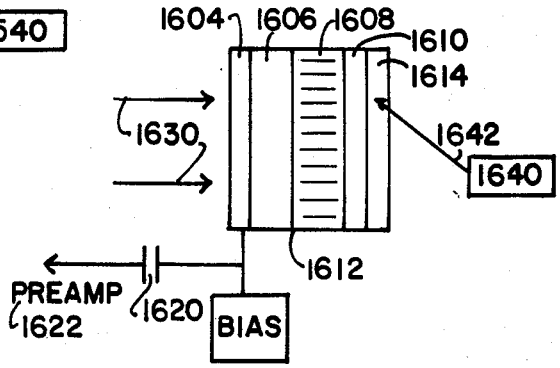
FIG. 16 is an illustration of the embodiment of the invention including flood guns inside the vacuum enclosure with the laser scanner and bias lights positioned outside.

Reference to FIGS. 15 and 16 reveal two alternative approaches, both using channel multipliers. In FIG. 15, the signal electrode is 1504 and the resistor to ground electrode is 1510 as described heretofore. Layer 1506 is a photoconductor responsive to the incident radiation 1530 passing through 1504. However, layer 1508 is now a channel multiplier placed between layer 1506 and electrode 1510. A raster scanner 1540 sends a high velocity beam of electrons through electrode 1510 and with proper bias voltage applied to 1504 (not shown) causes a displaced charge to be deposited at the interface 1512. On imaging exposure, the scanner and channel multiplier replace the lost charge and in the process generate a video signal which is picked up by the preamplifier 1522 through the coupling capacitor 1520. The channel plate can now be millimeters thick versus microns thick for designs described earlier, and correspondingly cause a drop in DELST capacity ranging from a few hundreds to a thousand or more. The multiplier need not operate with dramatically high gain, and the range of 1,000 to 10,000 should prove adequate for most cases.

An alternative approach is to operate the channel multiplier in the mode of a CRT, where the device has been placed in proximity to the phosphor surface. Relatively flat and thin CRT designs have been fabricated in which a low current electron beam scans the input surface of the channel multiplier. The multiplied current at the output scans the surface of the phosphor with energies generally in the range of 10–15 KeV. The separation between the phosphor surface and the channel multiplier is substantial and generally seems to be about 5 mm. This same approach could be applied to the DELST imager wherein the phosphor layer is replaced by the DELST structure. The advantages are clearly reduced distributed capacity and a small volume, large area imaging structure.

FIG. 16 shows the same basic scheme making use of the channel multiplier, but incorporating a laser raster scanner 1640 and a scanning laser beam 1642 passing through electrode 1614 to be absorbed by a photoemitter 1610 deposited on the channel multiplier 1608. Photoelectrons emitted from 1610 enter the channels of 1608, are multiplied and deposited on the interface 1612. On exposure by imaging radiation 1630, the video signal generated by scanning is picked up by preamplifier 1622 through the coupling capacitor 1620. The photoconductor 1606 is made of a material responsive to the spectrum of the incident radiation 1630.

The option to use the channel multiplier on the imaging side of the interface 1512 and 1612 for increased electronic image gain has been described in section 5. When used there, the capacity is reduced in the same manner as described above. It can be reduced further by adding the vacuum separation 1426 with proximity focussing for example.

Minimal distributed capacity can be achieved with the use of flood guns and bias lighting in the super high velocity beam scanning tube and the laser beam scanner imager. A description has already been presented on the use of flood guns and bias lighting with the super high velocity scanning beam and the laser scanner in sections 2 and 3. This approach in affect provides for a floating target electrode surface exposed to the scanner, bias lighting and the flood gun. It offers minimal capacity to the preamplifier and correspondingly minimizes associated preamplifier noise. The combination of flood gun, scanning beam, bias lighting and the bias on the signal surface electrode, provide the means for a balanced charge flow to the scanned surface and proper control of the scanned surface potential.

Flood beams offer an additional degree of complexity over the simplext structure, super high velocity tube. However, it is less complex then the version using the channel multiplier. The channel multiplier has the advantage of offering controllable gain for applications in which such gain might prove advantageous. Its impact will be discussed below.

DELST WITH CONTROLLABLE GAIN

In the various embodiments of the DELST structure described heretofore, stress was placed on the potential need for gain particularly for large area devices such as X-ray devices and low light level applications. This gain was a requirement on the input, imaging side of the DELST to overcome the large distributed capacity induced electronic noise in the video preamplifier. Obtaining gain was described for example using photoconductor in one version of DELST, and a channel multiplier in another. It should be noted that the magnitude of the gain is dependent, in either case, on a voltage drop across the layer, i.e., the photoconductor or the channel multiplier depending upon which is being used. Accordingly, gain can be controlled by the magnitude of the potential difference applied across the DELST electrodes.

Applications can exist where different gains are required to overcome different imaging conditions. For example, diagnostic radiology requires that for certain procedures, fluoroscopy be carried out prior to obtaining a diagnostic quality radiograph. The former is managed with a low X-ray exposure to minimize dose to the patient. It serves the dual purposes of providing the radiologist wtih a preliminary viewing of the body anatomy and the positioning of the X-ray imaging apparatus. A radiograph is then obtained with a much larger exposure, which is essential to obtaining a diagnostic quality image. Accordingly, fluoroscopy requires a much higher level of gain sufficient to ensure that the resultant image is of sufficient quality to meet its purposes. The diagnostic exposure, on the other hand, being much larger requires less gain in DELST to provide a suitable radiograph.

The design of the DELST structure as shown in FIG. 10, leads to a selection of resistivities for layers 1006 and 1008. This is to ensure the appropriate voltage drop across 1006 during exposure and 1008 during readout of the electronic image of the interface 1012. In effect, the potential difference applied across electrodes 1004 and 1010 combined with the resistance of layers 1006 and 1008, plus that associated with the interface layer 1012, determines the voltage drop across each of the layers and the interface. Accordingly, the potential differences across the electrodes 1004 and 1010 are selected to provide the necessary gains in 1006 during fluoroscopy and diagnostic imaging, and a third potential difference for the appropriate voltage drop across 1008 during raster scanning for readout. For example, the layer 1008 require a much larger voltage drop to provide an optimum scan readout, than would exist during exposure conditions set-up to optimize gain in 1006. Thus, after exposure and the formation of the electronic image at 1012, the electrodes 1004 and 1010 potential difference could be switched to a higher value to accommodate the requirements imposed by layer 1008 for optimum readout.

A substantial benefit in using the channel multiplier to substantially reduce capacity is in the opportunity to use fewer and wider stripe electrodes. This leads to more scan lines per stripe, fewer preamplifiers and the opportunity to readout and erase scattered events before readout within one stripe width. These factors lead to overall improved imaging frame rates and operational simplicity. Even real time imaging can be designed into a DELST system given all the options available to incorporate into a system.

In the structure described heretofore, biases have been arranged so that the first electrode is either positive or negative with respect to the second electrode taken as resistance coupled to ground. This results in a potential difference across the DELST structure such that it causes charge carriers to move in a preferred direction compatible with a specific DELST structure. It is clear that this description is presented for simplicity; that, in fact, the grounded electrode could be the first electrode and that the second electrode could be at a postive or negative potential relative to ground; that, in fact, neither electrode need be grounded to support a preferred potential difference, and that any bias arrangement need only be accompanied by proper electronic circuitry to transmit the video signal to preamplifier. Finally as has been discussed in the text of this patent, when the imaging device design is best suited to the use of flood guns and bias lighting, the second electrode can be disconnected from a known bias or from ground. In this mode of operation, the second surface potential floats and is determined by the performance of the flood beam, the bias lighting, the scanning beam, and the bias on the first electrode. Furthermore, the second surface can be bare of any conducting layer for best electrical isolation of pixels, or be coated for pertinent advantage when such isolation is not essential.

Other improvements, modifications and embodiments will become apparent to one of ordinary skill in the art upon review of this disclosure. Such improvements, modifications, and embodiments are considered to be within the scope of this invention as defined by the following claims.

I claim:

1. A scanner image tube comprising:

a first electrode and a line connected thereto for carrying a video signal from said first electrode;

a second electrode and a line connected thereto to establish a potential relative to said first electrode such as to cause charge carries to move in a predetermined direction;

a first layer;

a second layer; and means for providing a beam of irradiation which raster scans said second electrode at a distance therefrom;

wherein said first layer is sandwiched between said first electrode and said second layer; and wherein said second layer is sandwiched between said second electrode and said first layer; and wherein said first electrode comprises a first material which passes therethrough and into said first layer a pattern of image defining irradiation in a given spectral band; and wherein said second electrode comprises a second material which passes therethrough and into said second layer irradiation from said beam; and wherein said first layer and said second layer lie against each other at an interface region; and wherein said second layer comprises means for transporting and generating electrons to irradiation from said beam passing through said second electrode and striking said second layer, said generated charge carriers travelling toward the interface region whereat the carriers are blocked so as to become a uniformly charged surface layer; and wherein said first layer comprises means for generating charge carriers of opposite sign to the carriers generated in the second layer, in a pattern corresponding to the pattern of image-defining irradiation that passes through said first electrode and strikes said first layer, the pattern of these carrier travelling toward the interface to combine with stored carriers thereat to form an electronic charge image at the interface region; and wherein said charge carrier transporting and generating means provides sufficient carriers in response to the scanning of said second layer by said beam to recharge the interface and with charge balance maintained through the line connected to the second electrode, the video signal on said lines connected to either the first or second electrodes varying in amplitude over time the magnitude of recharging required for the portion of the interface subject to the scan.

2. A scanner image tube according to claim 1, wherein said first layer can be selected to provide a positive charge flow (holes) or a negative charge flow (electrons) to deplete carriers stored at the interface and to form a charge image.

3. A scanner image tube according to claim 1, wherein said second layer can be selected to provide a positive charge carrier flow (holes) or a negative charge flow (electrons) to store charge at the interface.

4. A scanner image tube according to claim 3, wherein the interface surface can store either a positive charge or a negative charge dependant upon the sign of the transported charge carrier and the direction of carrier flow, determined by said second layer selection.

5. A scanner image tube according to claim 1, wherein said second electrode is biased through a resistor via a connection to a selected source of potential, including ground.

6. A scanner image tube according to claim 1 wherein said beam providing means generates a high velocity electron beam; and wherein said electron generating means comprises a charge multiplication layer offering gain of unity or more, such that one or more electrons are generated for each electron from said electron beam that strikes said second layer.

7. A scanner image tube according to claim 6 wherein said beam providing means generates an electron beam of at least sufficient energy to cause charge multiplication, determined by the magnitude of gain required.

8. A scanner image tube according to claim 6 wherein said charge multiplication layer comprises an electron bombardment induced conductivity (EBIC) layer; and wherein said electron beam has sufficient energy to cause the magnitude of charge multiplication required in said EBIC layer.

9. A scanner image tube according to claim 6 wherein said charge multiplication comprises a material that multiplies charge by a gain factor sufficiently large to charge and recharge the interface layer.

10. A scanner image tube according to claim 6 wherein said charge multiplication layer comprises a channel multiplier layer.

11. A scanner image tube according to claim 6 wherein said charge multiplication layer comprises a secondary electron conductivity (SEC) material.

12. A scanner image tube according to claim 6 wherein said charge multiplication layer comprises semiconducting silicon.

13. A scanner image tube according to claim 1, wherein said second electrode is subject to a floating bias;

wherein the floating bias is established through the joint action of low velocity flood gun electrons, photoconductive current flow through the first layer induced with bias lighting, bias voltage on the first electrode and the super high velocity scanning beam;

wherein the bias lighting can be transmitted to the photoconductor through the first transparent electrode or through the second electrode and the second layer when in combination they are made either translucent or transparent.

14. A scanner image tube according to claim 1, wherein said second conducting surface electrode is removed and a floating potential established on the exposed second surface layer;

wherein the floating potential is established through the joint action of low velocity flood gun electrons, photoconductive current flow through the first layer induced with bias lighting, bias voltage on the first electrode and the super high velocity scanning beam;

wherein the bias lighting can be transmitted to the photoconductor through the first transparent electrode or through the second layer when it is made either translucent or transparent.

15. A scanner image tube according to claim 1 further comprising:

a third layer, said first electrode being sandwiched between said first layer and said third layer;

wherein said third layer converts an incident pattern in one form of radiation into the image-defining pattern of another form of radiation which passes through said first electrode to (a) strike said first layer and (b) generate holes in a pattern corresponding to the incident pattern.

16. A scanner image tube according to claim 15 wherein the incident pattern is in the form of X-radiation; and wherein said third layer comprises an X-ray sensor such as cesium iodide which (a) absorbs the X-radiation and (b) generates light photons to form the pattern of image-defining radiation in said given spectral band.

17. A scanner image tube according to claim 7 or claim 16 wherein said first electrode comprises a plurality of electrode stripes disposed substantially parallel to the direction of electron beam line scan;

said electrode stripes being substantially parallel to one another and placed side by side, said first electrode stripes thereby limiting the effective readout capacity in the scanner image tube.

18. A scanner image tube according to claim 1 wherein said electrode comprises at least one electrode stripe said first electrode stripe thereby limiting the effective readout capacity in the scanner image tube.

19. A scanner image tube according to claim 18 wherein said first electrode is positioned parallel to and displaced from said second electrode; and means for biasing said first electrode relative to said second electrode such that electronic carriers migrate from said one toward the other.

20. A scanner image tube according to claim 19 wherein said first electrode is at a positive voltage relative to said second electrode whereby the scanned charge is stored on said first layer at the interface.

21. A scanner image tube according to claim 19 wherein said first electrode is at a negative voltage relative to said second electrode.

22. A scanner image tube according to claim 18 or 19 or 20 or 21 wherein said stripe electrode or electrodes can be one raster line thick.

23. A scanner image tube according to claim 18 wherein said stripe signal electrode is a straight line.

24. A scanner image tube according to claim 1 wherein the center of the scan of said beam lies in the simplest example, at approximately a 0° angle relative to the direction of incident radiation.

25. A scanner image tube according to claim 1 or 17 wherein a single scanning beam is employed.

26. A scanner image tube according to claim 1 wherein multiple scanning beams are employed each scanning a different stripe area of said first electrode, and a distinct amplifier associated with each said stripe.

27. A scanner image tube according to claim 1 wherein one of said electrodes comprises a plurality of electrode stripes deposited parallel to the raster lines.

28. A scanner image tube according to claim 27 wherein said first electrode comprises a plurality of parallel stripes.

29. A scanner image tube according to claim 27 wherein said second electrode comprises a plurality of parallel stripes also parallel to the raster lines.

30. A scanner image tube according to claim 27 wherein both said electrodes comprise a plurality of said stripes.

31. A scanner image tube according to claim 17 wherein said each electrode stripe comprises for example a stripe of approximately 24 microns in width, said stripes being separated by 1 micron.

32. A scanner image tube according to claim 31 wherein said first electrode extends over an area of approximately 16 inches by 16 inches, each stripe being 16 inches long.

33. A scanner image tube according to claim 1 wherein said beam comprises a laser beam; and wherein said second layer comprises a photoconductive layer which generates at least electrons when struck by irradiation from said laser beam.

34. A scanner image tube comprising:

a first electrode;

a second electrode at a negative potential relative to said first electrode;

a solid-state first layer of high resistivity;

a charge multiplication second layer of high resistivity;

means for raster scanning an electron beam of sufficient energy to cause charge multiplication in the second layer;

wherein said first layer is sandwiched between said first electrode and said second layer; and wherein said second layer is sandwiched between said first layer and said second electrode; and wherein said raster scanning means directs high velocity electrons into said second layer through said second electrode, said second layer generating and conveying a greater number of electrons toward the interface between said first layer and said second layer than the number of electrons from said scanning means that strike said second layer; and wherein when said first electrode is exposed to a pattern of image-defining radiation which strikes said first layer, said first layer conveys a pattern of holes to the interface region of said first layer and said second layer analogous to the pattern of image-defining radiation.

35. A scanner image tube according to claim 34 wherein said charge multiplication layer comprises means for reducing beam resistance and lag.

36. A scanner image tube according to claim 35 wherein said charge multiplication layer comprises a material subject to avalanche breakdown, where struck by the high velocity electrons, said means providing enhanced reduction of beam resistance and lag reduction in response to avalanche breakdown of said charge multiplication layer between said second electrode and the interface region.

37. A scanner image tube according to claim 35 wherein the holes conveyed to the interface combine with the electrons conveyed thereto through said second layer; and wherein a recharge ratio of (a) the number of electrons conveyed to the interface through said charge multiplication layer to (b) the number of electrons which combine with holes at the interface is substantially greater than one.

38. A scanner image tube according to claim 25 wherein said charge multiplication layer when struck by electrons from the scanning means conveys sufficient electrons resulting from a recharge ratio to be broadly in the range of unity to in excess of 10,000.

39. A scanner image tube according to claim 38 further comprising:

a third layer, said first electrode being sandwiched between said first layer and said third layer;

said third layer converting an input image-representing pattern of X-radiation which impinges thereon into a corresponding incident pattern of photons which pass through said first electrode to strike said first layer;

said first layer generating holes which travel to said interface and electrons which travel to said first electrode in response to photons striking said first layer.

40. A scanner image tube comprising:

a first electrode;

a second electrode, said first electrode being at a predetermined potential relative thereto;

a first solid state layer which generates electrons and holes when struck by radiation;

wherein said first layer is sandwiched between said first electrode and said second layer; and wherein said second layer is sandwiched between said first layer and said second electrode, said first layer lying against said second layer to form an interface region; and raster scanning means for directing a radiation beam into said second layer through said second electrode, said second layer being struck by the beam electrons and causing current flow in an amount depending on imaging storage requirements, with electrons conveyed toward the interface region for storage thereat and with charge neutrality maintained in the second layer through the second electrode and connecting resistor;

the electrons stored at the interface region forming an electron layer displaced from said second electrode, the electrons of said electron layer being combinable with holes generated in said first layer in response to radiation passing through said first electrode into said first layer;

the combining of holes from said first layer with electrons from said second layer at the interface region forming an electronic image thereat.

41. A scanner image tube according to claim 40 wherein said second layer is subject to local electronic breakdown, where struck by the beam; and wherein the resistance provided by said second layer to electrons being conveyed to a given pixel of the interface reduces with increased electron generation between said second electrode and the given pixel;

the resistance provided by said second layer approaching zero along direct paths between said second electrode and a pixel which have undergone total electronic breakdown.

42. A scanner image tube according to claim 41 wherein (a) the number of electrons conveyed to any pixel at the interface region when said second layer is struck by the beam and (b) the maximum number of electrons combinable with holes at said any pixel at the interface region are in a recharge ratio of at least unity to in excess of 10,000.

43. A scanner image tube according to claim 41 further comprising:

a third layer, said first electrode being sandwiched between said first layer and third layer;

said third layer converting an incident pattern of X-radiation which impinges thereon into a corresponding image-defining pattern of photons which pass through said first electrode to strike said first layer, said first layer generating holes which travel to the interface region and electrons which travel to said first electrode in response to photons striking said first layer.

44. A scanner image tube according to claim 41 wherein the scanner image tube responds to irradiation from an object, which irradiation passes through said first electrode and strikes said first layer; and wherein the scanner image tube further comprises:

intensifier means, interposed between the object and the interface region, for increasing the number of generated holes combinable with electrons at the interface for a given level of radiation from the object;

said recharge ratio being at least unity to in excess of 10,000 for each pixel of the interface.

45. A scanner image tube according to claim 41 wherein said first layer is a thin crystalline layer.

46. A scanner image tube according to claim 41 wherein first layer generates electron-hole pairs, the electrons from which drift to said first electrode; and wherein said second layer generates electron-hole pairs, the holes from which drift to said second electrode.

47. A method of producing with a scanner image tube a video signal corresponding to the image of an object, the method comprising the steps of:

sandwiching a first layer between a first electrode and a second layer;

sandwiching the second layer between the first layer and a second electrode;

applying an electric field between the two electrodes;

exposing the first electrode to irradiation limited to a first spectral band corresponding to the image of the object wherein the first electrode is transparent to irradiation in the first spectral band but not in a second spectral band;

scanning the second electrode with an optical beam of irradiation limited to the second spectral band distinct from the first spectral band wherein the second electrode is transparent to irradiation in the second spectral band but not in the first spectral band; and forming an electronic image at the interface region between the first layer and the second layer, said forming step comprising the steps of:

selecting the second layer of a photoconductive material which generates electrons in the second layer when scanned with the beam, the electrons drifting to the interface under the influence of the electric field to promote a uniformly charged electron layer at the interface; and selecting the first layer of a material which generates holes therein when irradiation in the first spectral band impinges thereon through the first electrode, the holes drifting to the interface under the influence of the electrical field to combine with electrons at the interface.

48. A method according to claim 47 comprising the further step of:

reading out surges of electron flow as the optical beam is scanned to provide a video signal output.

49. A method according to claim 47 comprising the further step of:

supplying electrons from said second layer to recharge the interface region with electrons, responsive to said scanning of the beam and the generating of electrons in said second layer.

50. A method according to claim 49 comprising the further step of:

draining excess electrons out of the second layer through the line connected to the second electrode.

51. A method according to claim 49 or 50 wherein said supplying step includes the step of supplying electrons to the interface region to promote a fixed uniform charge density and a fixed equilibrium voltage thereat.

52. A method according to claim 47 wherein said selection of material for said second layer includes the step of:

selecting a material that undergoes avalanche breakdown locally where subjected to the scanning beam.

53. A method according to claim 47 wherein selecting the second layer material comprises the step of:

selecting a material of high resistivity subject to local avalanche breakdown;

wherein the resistance to the flow of generated electrons along a path through the second layer to the interface, where the path has undergone avalanche breakdown, approaches zero; and wherein the high resistivity of the second layer inhibits lateral spread of charge.

54. A scanner image tube comprising:

a vidicon-type tube including:

(a) means for providing a low velocity beam;

(b) a sensor-target having a surface of a given area; and (c) a plurality of stripe signal electrodes transparent to incident radiation arranged side-by-side spanning the area of the sensor-target surface, said stripe signal electrodes being substantially aligned with the direction of raster line scan, the width of the stripe signal electrodes being at least equal to the width of a raster line, said stripe signal electrodes having narrow widths which represent low distributed and target capacitance relative to single element electrodes;

a plurality of preamplifiers, each preamplifier being connected to a respective one of said stripe signal electrodes; and a plurality of storage elements, each storage element being connected to receive input from a respective one of said preamplifiers and each storage element including means for separately storing in memory inputs corresponding to each raster line scanned along a given stripe signal electrode.

55. A scanner image tube according to claim 54 further comprising:

analog signal multiplexing to reduce the number of preamplifiers necessary.

56. A scanner image tube according to claim 54 further comprising:

means for reading out simultaneously in parallel the stored inputs corresponding to all stripe signal electrodes when the entire target-sensor surface is exposed to beam radiation at one time.

57. A scanner image tube according to claim 54 wherein said incident radiation comprises at least one fan beam oriented to project radiation parallel to the electrode stripes.

58. A scanner image tube according to claim 57 wherein at least two fan beams scan simultaneously, reducing the time required to scan a raster.

59. A scanner image tube according to claim 57 further comprising:

means for translating said fan beam from one stripe signal electrode to another; and means for serially reading out the stored inputs for successive stripe signal electrodes as the fan beam is translated.

60. A scanner image tube according to claim 54 wherein the stripe signal electrodes are of equal width.

61. A scanner image tube according to claim 57 further comprising:

means for erasing residual imagery and scatter from prior exposures, said erasing means including means for scanning raster lines before fan beam exposure.

62. A scanner image tube according to claim 54 or 57 or 61 further comprising:

means for selectively bias switching each of said stripe signal electrodes, thereby limiting sensitivity to stripes exposed to fan beam readiation while all others are not responsive and do not record any direct or scattered radiation.

63. A scanner image tube comprising:

a displaced electron layer sensor-target (DELST) which includes stripe signal electrodes, transparent to incident radiation, said stripe signal electrodes being arranged side by side to span the sensor-target surface area, said stripes being sufficiently wide to be scanned by at least one raster line whose length is parallel to said stripe signal electrodes, each stripe width being defined so that the area of each stripe signal electrode is sufficiently small to minimize excessive operational capacity;

a high velocity beam for scanning said DELST, said high velocity beam and said DELST cooperating to avoid large beam impedance associated with low velocity beam, and charge redistribution effects associated with high velocity vidicon type tubes.

64. A scanner image tube according to claim 63 wherein the DELST includes a photoconductive layer for the sensor-target which is responsive to incident radiation, said photoconductive layer providing substantial photoconductive gain so as to boost the signal layer to as much as hundreds of micoramperes.

65. A scanner image tube according to claim 64 further comprising:

forefront intensifier means for adding gain to the signal level.

66. A scanner image tube according to claim 63 further comprising:

electron multiplier means for producing high values of beam current within the layer while using a relatively small current scanner beam outside the layer.

67. A scanner image tube according to claim 63 further comprising:

a plurality of preamplifiers, each preamplifier connected to receive a video signal from a respective one of said stripe signal electrodes.

68. A scanner image tube according to claim 67 further comprising:

a plurality of storage elements, each storage element being connected to receive input from a respective one of said preamplifiers and each storage element including means for separately storing, in memory, inputs corresponding to each raster line scanned along a given stripe signal electrode.

69. A scanner image tube according to claim 63 further comprising:

means for reading out simultaneously in parallel the stored inputs corresponding to all stripe signal electrodes when the entire target-sensor surface is exposed to beam radiation at one time.

70. A scanner image tube according to claim 63 further comprising:

at least one fan beam;

means for translating said at least one fan beam from one stripe signal electrode to another; and means for serially reading out the stored inputs for successive stripe signal electrodes as the fan beam is translated.

71. A scanner image tube according to claim 63 wherein said displaced electron layer stores a formed image thereon from which a video signal is generated during scanning by said beam.

72. A scanner image tube according to claim 63 further comprising:

means for erasing residual imagery and scatter from prior exposures, said erasing means including means for scanning raster lines before fan beam exposure.

73. A scanner image tube according to claim 72 further comprising:

means for bias switching so that only the DELST stripe exposed directly by the fan beam is responsive to the incident radiation.

74. A scanner image tube comprising:

a displaced electron layer sensor-target (DELST) which includes at least one stripe signal electrode, transparent to incident radiation, said stripe signal electrodes being arranged side by side to span the sensor-target surface area, said stripes being sufficiently wide to be scanned by at least one raster line whose length is parallel to said stripe signal electrodes, each stripe width being defined so that the area of each stripe signal electrode is sufficiently small to minimize excessive operational capacity;

an optical beam for scanning said DELST, said optical beam and said DELST cooperating to avoid large beam impedance associated with low velocity beam and charge redistribution effects associated with high velocity beam vidicon type tubes.

75. A scanner image tube according to claim 74 wherein said optical beam is a laser beam raster scanner.

76. A scanner image tube according to claim 74 further comprising:

a plurality of preamplifiers, each preamplifier being connected to receive a video signal from a respective one of said stripe signal electrodes.

77. A scanner image tube according to claim 76 further comprising:

a plurality of storage elements, each storage element being connected to receive input from a respective one of said preamplifiers and each storage element including means for separately storing in memory inputs corresponding to each reaster line scanned along a given stripe signal electrode.

78. A scanner image tube according to claim 74 further comprising:

means for reading out simultaneously in parallel the stored inputs corresponding to all stripe signal electrodes when the entire target-sensor surface is exposed to beam radiation at the same time.

79. A scanner image tube according to claim 74 further comprising:

at least one fan beam;

means for translating said at least one fan beam from one stripe signal electrode to another; and means for serially reading out the stored inputs for successive stripe signal electrodes responsive to the fan beam being translated.

80. A scanner image tube according to claim 74 further comprising:

means for erasing residual imagery and scatter from prior exposures, said erasing means including means for scanning raster lines before fan beam exposure.

81. A scanner image tube according to claim 80 further comprising:

means for bias switching so that only the DELST stripe exposed directly by the fan beam is responsive to the fan beams radiation.

82. A scanner image tube according to claim 74 said DELST further comprising:

a photoconductive layer which transforms the optical beam into a high value electron current beam within said photoconductive layer;

the scanning by said optical beam resulting in the generation of a video signal corresponding to the charges stored at the displaced electron layer which represent a formed image.

83. A scanner image tube comprising:

a video-type tube including:

(a) means for providing a high velocity beam;

(b) a sensor-target having a surface of a given area; and (c) a plurality of stripe signal electrodes transparent to incident radiation arranged side-by-side spannning the area of the sensor-target surface, said stripe signal electrodes being substantailly aligned with the direction of raster line scan, the width of the stripe signal electrodes being at least equal to the width of a raster line, said stripe signal electrodes having narrow widths which represent low distributed and target capacitance relative to single element electrodes;

a plurality of preamplifiers, each preamplifer being connected to a respective one of said stripe signal electrodes; and a plurality of storage elements, each storage element being connected to receive input from a respective one of said preamplifiers and each storage element including means for separately storing in memory inputs corresponding to each raster line scanned along a given stripe signal electrode.

84. A scanner image tube according to claim 80 or 83 further comprising:

means for reducing the potential of a stripe being scanned relative to adjacent stripes whereby some secondary charge carriers are diverted to said adjacent stripes.

85. A scanner image tube according to claim 84 wherein said tube has a collector grid, said collector grid being located and having a potential relative to said scanned stripe and that some of said secondary charge carriers are diverted to said grid.

86. A scanner image tube according to claim 83 further comprising:

at least one fan beam;

means for translating said fan beam from one stripe signal electrode to another; and means for serially reading out the stored inputs for successive stripe signal electrodes as the fan beam is translated.

87. A scanner image tube according to claim 85 further comprising:

means for scanning raster lines before fan beam exposure.

88. A scanner image tube according to claim 87 further comprising:

means for making adjacent stripe sensors insensitive through removal of the potential difference across a sensor when both its electrodes comprise stripes.

89. A scanner imager comprising:

a first electrode;

a second electrode, said first electrode being at a specified potential relative to;

a third photoemissive-sensor layer for generating electrons when struck by radiation;

a first layer comprising a channel multiplier having an input surface in contact with the third photoemissive-sensor layer, said third layer being adjacent to and in electrical contact with the first electrode, said third layer being sandwiched between said first layer and said first electrode, said first layer being sandwiched between said third layer and said second layer, said second layer being sandwiched between said first layer and said second electrode, with said first layer lying against said second layer to form an interface region;

said raster scanning means directing the radiation beam into said second layer through said second electrode, said second layer being struck by the beam generating charge carriers which migrate to the interface whereby a positive charge is formed at the interface and is displaced from the second electrode, and in position to be discharged by electrons, generated in said third and first layers respectively, in response to imaging radiation passing through the first electrode into said third layer, and causing the formation of an electronic image at the interface, said raster scanning means generating a video signal on recharging the interface.

90. The image scanner according to claim 1 further comprising a channel multiplier located between one of said layers and one of said electrodes.

91. The image scanner according to claim 1 or claim 90 further comprising means for varying the gain of said image scanner by selectively varying the potential across said electrodes.

92. A scanner image tube comprising:

a DELST structure, a first electrode transparent to imaging radiation and a charge multiplying second layer devoid of any second transparent conducting electrode, a super high velocity beam for scanning said DELST;

a flood gun to provide a flow of electrons for charging the exposed surface of the second layer and to establish a floating potential;

a bias light positioned in front to illuminate the photoconductive first layer through the first electrode or in the rear to illuminate the first layer through a transparent or translucent multiplying layer;

a means for the scanning beam, bias light and flood gun to operate in combination to establish the storage charge at the interface surface and an equilibrium potential difference between the first and second layers;

a means for minimizing noise inducing capacity to the preamplifier, wherein the charge stored on any pixel of the second layer surface is available for signal generation during the high velocity beam scan;

a means for sequencing the process of charge storage, exposure and video signal generation.

93. A scanner image tube according to claim 92 operating in a pulsed mode, wherein the exposure, bias light, flood gun and scanner are pulsed to operate in any sequence needed for a particular imaging requirement.

94. A scanner image tube according to claim 92 operating in a continuous mode of operation, wherein the flood beam, bias light, scanning beam and exposure are in operation simultaneously and continuously.

95. A scanner image tube according to claim 92 structured with the first electrode divided into stripes to further minimize capacity when applications warrent.

96. A scanner image tube comprising:

a DELST structure, a first electrode transparent to imaging radiation and a charge multiplying second layer with a second transparent conducting electrode, a high velocity beam for scanning said DELST;

a flood gun to provide a flow of electrons for charging the second electrode and to establish a floating potential;

a bias light positioned in front to illuminate the photoconductive first layer with light passing through the transparent first electrode or positioned in the rear to illuminate the photoconductive first layer with light passing through a transparent or translucent second electrode and multiplying layer;

a means for the scanning beam, bias light and the flood gun to operate in combination to establish the storage charge at the interface surface;

a means for the scanning beam, bias light and the flood gun to operate in combination to establish an equilibrium potential difference between the first and second electrodes;

a means for reducing noise inducing capacity to the preamplifier while permitting charge stored on the second electrode to be shared by pixels during scanning for signal generation.

97. A DELST image tube according to claim 96 operating in a pulsed mode wherein the scanner, bias light and flood gun can operate in any sequence as required by the imaging procedure.

98. A DELST image tube according to claim 96 operating in a continuous mode for real time imaging wherein the scanner beam, bias light and flood gun are in operation simultaneously and continuously.

99. A scanner image tube according to claim 96 structured with the first electrode divided into stripes to further minimize capacity when applications warent.

100. A scanner image tube according to claim 96, where the conducting electrode is extended outside the scanned raster area for non-iteractive flood beam and scanner beam operation, where the flood beam electrons are trained on the conducting electrode without intruding into sphere of electron optics governing the performance of the scanning electron beam.

101. A scanner image tube comprising:

a DELST structure, a first electrode transparent to imaging radiation, a photoconductive first layer responsive to imaging radiation, a photocondutive second layer devoid of any second transparent electrode and respnonsive to a laser beam for scanning said DELST;

a flood gun to provide a flow of electrons for charging the exposed surface of the second layer;

a bias light positioned to illuminate the first layer through the transparent first electrode or positioned to illuminate the first layer with selected radiation able to pass through the photoconductive second layer and absorbed by the first layer;

a means for scanning beam, bias light and flood beam to operate in combination to establish the storage charge at the interface surface and the equilibrium potential difference between the first electrode and the exposed surface of the second layer;

a means for minimizing noise inducing capacity to the preamplifier.

102. A DELST vacuum tube according to claim 101 where the tube is designed to include the flood gun and to contain windows transparent to the laser and bias light radiation, and positioned to place the flood gun so as not to interfere with the optical path of the laser and flood beam radiation coming from outside the vacuum tube.

103. A DELST image tube according to claim 101 operating in a pulsed mode, wherein the flood gun, bias light, exposure and the scanner are pulsed in a sequence as needed for an imaging requirement.

104. A DELST image tube according to claim 101 operating in a continuous mode, wherein the flood beam, bias light, scanning beam and exposure are in operation simultaneously and continuously.

105. A DELST image tube according to claim 101 structured with the first electrode divided into stripes to further minimize capacity when applications warrent.

106. A scanner image tube comprising:

a DELST structure, a first electrode transparent to imaging radiation, a photoconductive first layer responsive to imaging radiation, a second photoconductive layer responsive to laser beam radiation and supporting a second conducting electrode transparent to LASER radiation, and a LASER beam for scanning said DELST;

a flood gun to provide a flow of electrons for charing the second electrode;

a bias light which when positioned for its radiation to pass through the first electrode causes a photoconductive response in the first layer, and when positioned for its radiation to pass through the second electrode, is able also to pass through the second layer photoconductor and to cause a photoconductive response in the first layer;

a means for the scanning beam, bias light and the flood gun to operate in combination to establish the storage charge at the interface surface and the second electrode as well as the equilibrium potential across the first and second electrodes;

a means for reducing noise inducing capacity to the preamplifier;

a means for sequencing the process of charge storage, exposure and video signal generation.

107. A DELST image vacuum tube according to claim 106 where the image tube is designed to include windows transparent to the laser radiation and to the bias light radiation located so that the optical paths of the laser scanning beam and the bias light irradiating the second electrode are not obstructed by the flood gun.

108. A scanner image tube according to claim 106 operating in a pulsed mode, wherein the flood gun, bias light, laser scanner and exposure are pulsed in a manner designed to meet the needs of an imaging requirement.

109. A scanner image tube according to claim 106, operating in a continuous mode of operation, wherein the flood beam, the scanning beam, bias light and exposure are in operation simultaneously and continuously.

110. A scanner image sensor according to claim 106, structured so that the second electrode has an extension which comprises an appendage placed so that the flood gun is off to the side of the second electrode and permits more direct placement of the transparent windows relative to the laser scanner, bias light and the scanned raster.

111. A scanner image tube according to claim 110 structured with the first electrode divided into stripes to further minimize capacity when applications warrent.

112. A scanner image tube comprising:

a DELST structure, a first electrode transparent to imaging radiation and a charge multiplying second layer with a second transparent conducting electrode;

a channel multiplier whose output is in proximity focusing to the second electrode and whose input surface is raster scanned by a high velocity electron beam, whose output can have acceleration potentials adjusted to provide an amplified scanning high velocity electron current or a low velocity electron current trained on the second electrode;

a means for the scanning high velocity beam and the low velocity beam to operate in combination to establish the storage at the interface;

a means for the low velocity beam operation to charge the second electrode;

a means for the high velocity beam to generate a video signal during the scan after exposure;

a means for the electron optics governing scanning electron beam input to the channel multiplier to be designed at least similar to a flat panel type display;

a means for a bias light positioned to expose the first layer from the front through the first electrode or from the rear through the second electrode and the multiplying layer for the purpose of maintaining an equilibrium potential across the first and second electrodes.

113. A scanner image tube according to claim 112, where the second electrode is extended beyond the area covered by the raster, and where a flood gun can be added to provide low velocity electrons for deposition cn the second electrode, and where separate scanning and flood guns permit the choice of their simultaneous or pulsed sequence operation.

114. A scanner image tube according to claim 112, where the second electrode is removed.

115. A scanner image tube according to claim 113 or 114 structured with the first electrode divided into stripes to further minimize noise inducing capacity when applications warrent.

116. A scanner image tube comprising:

a DELST structure, a first electrode transparent to imaging radiation and a photoconductive second layer with a second transparent electrode;

a channel multiplier positioned in a manner resembling a third generation low light level intensifier, whose output is in proximity focusing to the second electrode and whose input surface is in proximity focusing to a photoelectron emitter deposited on a transparent electrode surface;

a laser scanner trained on the photoemitter surface to generate an electron beam scan at the input to the channel multiplier;

a control of the accelerating potential at the output of the channel multiplier to permit high velocity or low velocity electrons to reach the second electrode;

a means for the high and low velocity beams to operate in combination to establish the storage charge at the interface;

a means for the low velocity beam operation to charge the second electrode;

a means for the high velocity beam to generate a video signal during the scan after exposure;

a means for a bias light to be positioned so that its radiation can pass through the first electrode and expose the first layer or pass through the second electrode and the multiplying layer to expose the first layer, for the purpose of maintaining an equilibrium potential across the first and second electrodes.

117. A scanner image tube according to claim 116, where the second electrode is extended beyond the area covered by the raster as an appendage, and a separate flood gun is positioned to train flood beam electrons on to the second electrode extension, and where the sources of the scanning beam and flood beam permit their simultaneous operation.

118. A scanner image tube according to claim 116, where the second electrode is removed.

119. A scanner image tube according to claim 116, structured with the first electrode divided into stripes to further minimize noise inducing capacity when applications warrent.

120. A scanner image tube according to claim 1, wherein said first electrode is adapted for coupling to a video preamplifier by the attachment of a resistor through which said preamplifier would be coupled.

121. A scanner image tube according to claim 1, wherein said second electrode is adapted for coupling to a video preamplifier by the attachment of a resistor through which said preamplifier would be coupled.

* * * * *